US009707775B2

(12) United States Patent
Terada

(10) Patent No.: US 9,707,775 B2
(45) Date of Patent: Jul. 18, 2017

(54) INK-JET RECORDING APPARATUS AND INK-JET RECORDING METHOD

(71) Applicant: Kohei Terada, Kiyosu-shi (JP)

(72) Inventor: Kohei Terada, Kiyosu-shi (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 184 days.

(21) Appl. No.: 14/146,166

(22) Filed: Jan. 2, 2014

(65) Prior Publication Data

US 2014/0111590 A1 Apr. 24, 2014

Related U.S. Application Data

(62) Division of application No. 12/977,356, filed on Dec. 23, 2010, now Pat. No. 8,641,162.

(30) Foreign Application Priority Data

Dec. 24, 2009 (JP) ..... 2009-293146

(51) Int. Cl.
*B41J 3/407* (2006.01)
*B41J 11/00* (2006.01)

(52) U.S. Cl.
CPC ..... *B41J 3/4071* (2013.01); *B41J 11/007* (2013.01); *B41J 11/008* (2013.01)

(58) Field of Classification Search
CPC ..... B41J 3/4071
See application file for complete search history.

(56) References Cited

U.S. PATENT DOCUMENTS

| | | | | |
|---|---|---|---|---|
| 2004/0017459 | A1 | 1/2004 | Kawaguchi et al. | |
| 2004/0052564 | A1* | 3/2004 | Fujita | B41J 11/008 400/76 |
| 2005/0206661 | A1* | 9/2005 | Lugaresi et al. | 346/131 |
| 2007/0109341 | A1* | 5/2007 | Niioka | 347/19 |
| 2011/0057382 | A1* | 3/2011 | Shinozaki et al. | 271/110 |

FOREIGN PATENT DOCUMENTS

| | | |
|---|---|---|
| JP | 2002-334553 | 11/2002 |
| JP | 2003-94740 | 4/2003 |
| JP | 2004-42392 | 2/2004 |
| JP | 2005-144931 | 6/2005 |
| JP | 2008-103025 | 5/2008 |

OTHER PUBLICATIONS

Notice of Reasons for Rejection for JP Application No. 2013-230919 dated Jul. 28, 2015.

* cited by examiner

*Primary Examiner* — Shelby Fidler
(74) *Attorney, Agent, or Firm* — Haug Partners LLP

(57) ABSTRACT

An ink-jet recording apparatus is provided, including a first transport section which transports a recording medium; a recording section which is formed with a plurality of nozzles and which records an image on the recording medium by discharging ink droplets from the nozzles; an interference member which is provided at a position separated from the recording section; and a control unit which controls the recording section so that only a part of the nozzles is used for a certain area of the recording medium.

7 Claims, 16 Drawing Sheets

Fig. 11

| IMAGE RECORDING POSITION | L4 | L6 | USABLE NOZZLE | NOZZLE ACTUALLY USED IN FIRST PASS |
|---|---|---|---|---|
| 1ST RASTER | 0 | 30 | N1～N3 | N1 |
| 5TH RASTER | 4 | 26 | N1～N4 | N2 |
| 9TH RASTER | 8 | 22 | N1～N5 | N3 |
| 13TH RASTER | 12 | 18 | N1～N6 | N4 |
| 17TH RASTER | 16 | 14 | N1～N7 | N5 |
| 21ST RASTER | 20 | 10 | N1～N8 | N6 |
| 25TH RASTER | 24 | 6 | ARBITRARY NOZZLES | N7 |
| 29TH RASTER | 28 | 2 | ARBITRARY NOZZLES | N8 |
| 33TH RASTER | 32 | −2 | ARBITRARY NOZZLES | N9 |

INK-JET RECORDING APPARATUS AND INK-JET RECORDING METHOD

CROSS REFERENCE TO RELATED APPLICATION

The present application is a divisional of U.S. patent application Ser. No. 12/977,356 filed on Dec. 23, 2010, which claims priority from Japanese Patent Application No. 2009-293146, filed on Dec. 24, 2009, the disclosure of which is incorporated herein by reference in its entirety.

BACKGROUND OF THE INVENTION

Field of the Invention

The present invention relates to an ink-jet recording apparatus and an ink-jet recording method in which an image is recorded on a recording medium having a high rigidity including, for example, CD and DVD.

Description of the Related Art

An image recording apparatus, in which an ink is discharged on the basis of an input signal to record an image on a recording medium, has been hitherto known. Such an image recording apparatus is generally referred to as "ink-jet printer". In the ink-jet printer, the ink is selectively discharged from a plurality of nozzles provided for a recording head. Accordingly, the image is recorded on the recording medium.

Those having been proposed as the recording medium subjected to the image recording in the ink-jet printer also include recording media having high rigidities such as CD, DVD and the like in addition to the recording paper and the like. In general, when the image recording is performed on the recording medium having the high rigidity such as CD, DVD or the like, the recording medium is set in an exclusively usable tray. In general, the tray is inserted from an insertion port provided for the ink-jet printer, and the tray is transported in the ink-jet printer. In some ink-jet printers, the recording medium having the high rigidity itself is sometimes inserted from the insertion port, and the recording medium having the high rigidity is transported in the ink-jet printer. The tray and/or the recording medium is/are transported in a predetermined amount in a first transport direction, and then the tray and/or the recording medium is transported in a second transport direction opposite to the first transport direction. An image is recorded on the recording medium, which has been transported to a position just under the recording head, by discharging the ink from the nozzles. The tray including the recording medium on which the image has been recorded or the recording medium on which the image has been recorded is discharged from the insertion port.

Japanese Patent Application Laid-open No. 2005-144931 discloses an ink-jet recording apparatus as an example of the ink-jet printer capable of recording an image on the recording medium having the high rigidity. In the ink-jet printer, a transport passage for a tray is formed by releasing a transport driven roller from a transport driving roller, wherein the tray carries CD, DVD or the like set thereon and is to be inserted in the first transport direction from a tray insertion port. Another ink-jet recording apparatus is also known, wherein a forward end of a tray, which carries CD, DVD or the like set thereon and which is to be inserted in the first transport direction from a tray insertion port, is transported to a position separated in the first transport direction as compared with a paper feed unit arranged on the backward side of the apparatus.

SUMMARY OF THE INVENTION

The recording medium having the high rigidity and the tray on which the recording medium is set cannot be bent to a large extent unlike a sheet-shaped recording medium such as the paper or the like. Therefore, when the recording medium having the high rigidity or the tray on which the recording medium is set is transported to the downstream of the recording head in the first transport direction, the tray protrudes to the downstream of the recording head in the first transport direction. For this reason, the transport driven roller, which is arranged on the downstream side of the recording head in the first transport direction, is released from the transport driving roller in the ink-jet recording apparatus described in Japanese Patent Application Laid-open No. 2005-144931 described above. In this case, it is necessary to add a release mechanism for releasing the transport driven roller from the transport driving roller. However, the cost of the apparatus is raised and the apparatus is large-sized due to the addition of the release mechanism.

In the case of the another ink-jet recording apparatus described above, it is feared that the forward end of the protruding tray may collide with a casing of the apparatus. In order to avoid the collision, it is necessary to provide an opening for the apparatus and/or increase the size of the apparatus. If the tray protrudes from the opening, the apparatus should be installed while being separated from the wall of the room in which the apparatus is installed, by an amount of the protrusion of the tray.

The present invention has been made taking the foregoing problems into consideration. An object of the present invention is to provide an ink-jet recording apparatus and an ink-jet recording method in which the transport amount of the recording medium having a high rigidity or the transport amount of a tray on which the recording medium is carried can be decreased, the transport amount being measured from the nozzle toward the downstream side in the first transport direction, and an image can be recorded on an entire area of the recording medium.

According to a first aspect of the present invention, there is provided an ink-jet recording apparatus which performs recording of an image by discharging ink droplets onto a recording medium including:

a casing;

a first transport section which transports the recording medium, in a first transport direction or a second transport direction which is a reverse direction of the first transport direction, in which a first distance is a distance ranging from a first position as a forward end in the first transport direction to a second position as a backward end to be subjected to the recording of the image;

a recording section which is provided in the casing on a downstream side in the first transport direction with respect to the first transport section, which includes a plurality of nozzles formed in the recording section over a second distance ranging from a third position located on a most downstream side in the first transport direction to a fourth position located on a most upstream side of the first transport direction, and which records the image on the recording medium by discharging the ink droplets from the nozzles;

an interference member which is provided in the ink-jet recording apparatus at a position separated from the third position by a third distance in the first transport direction, the third distance being smaller than the first distance and a total of the second distance and the third distance being greater than the first distance; and a control unit which controls the recording section to record the image on the recording medium so that under the condition that a fourth distance is less than a fifth distance, the recording section uses parts of the nozzles, which are separated from the third position in the second transport direction opposite to the first transport direction by not less than a sixth distance, wherein the fourth distance is a distance between the second position and the image recording position located on the most downstream side in the first transport direction in an image recording range in relation to the recording medium, the fifth distance is a distance obtained by subtracting the third distance from the first distance, and the sixth distance is a distance obtained by subtracting the fourth distance from the fifth distance.

If the third distance L3 is larger than the first distance L1 (L3>L1), the recording medium is not brought in contact with the interference member even when the image is recorded on the recording medium by using arbitrary nozzles. If the first distance L1 is larger than the total of the third distance L3 and the second distance L2 (L1>L2+L3), it is impossible to prevent the recording medium from being brought in contact with the interference member even when the image is recorded on the recording medium by using any nozzle. In the present invention, the first distance L1 is larger than the third distance L3, and the first distance L1 is smaller than the total of the second distance L2 and the third distance L3 (L3<L1<L2+L3). Therefore, it is possible to avoid the contact between the interference member and the recording medium by recording the image on the recording medium by using the specified nozzles. In the present invention, the term "recording medium" refers to the recording medium itself such as CD, DVD or the like when the recording medium such as CD, DVD or the like is transported singly. When the recording medium such as CD, DVD or the like is transported while being placed on a tray, one including the tray as well is referred to as "recording medium".

Further, if the vicinity of the backward end of the recording medium in the first transport direction is subjected to the image recording by using the nozzles disposed in the vicinity of the most downstream side in the first transport direction, then the distance, which ranges from the third position to the forward end of the recording medium in the first transport direction, is increased, and the recording medium consequently collides with the interference member. However, in the present invention, the vicinity of the backward end of the recording medium in the first transport direction (position disposed within the fifth distance L5 in the first transport direction from the second position) is subjected to the printing with the nozzles which are not disposed in the vicinity of the most downstream side in the first transport direction (nozzles which are separated from the third position by not less than sixth distance L6 in the second transport direction opposite to the first transport direction). Therefore, the forward end of the recording medium in the first transport direction is not separated from the third position by not less than the third distance L3 toward the downstream side in the first transport direction.

According to a second aspect of the present invention, there is provided an ink-jet recording method including:

preparing an ink-jet recording apparatus including a first transport section which transports, in a first transport direction or a second transport direction which is a reverse direction of the first direction, a recording medium in which a first distance is a distance ranging from a first position as a forward end in the first transport direction to a second position as a backward end to be subjected to image recording; a recording section which is provided on a downstream side in the first transport direction as compared with the first transport section, which is formed with a plurality of nozzles over a second distance ranging from a third position disposed on a most downstream side in the first transport direction to a fourth position disposed on a most upstream side, and which records an image on the recording medium by discharging ink droplets from the nozzles; and an interference member which is provided at a position separated from the third position by a third distance in the first transport direction, the third distance being smaller than the first distance and a total of the second distance and the third distance being larger than the first distance;

judging whether or not the recording medium is sheet-shaped on the basis of a detection result obtained by a detecting section for detecting the recording medium or an instruction executed for an operating section in order to instruct an operation of the apparatus; and recording the image on the recording medium by using only the nozzles which are separated from the third position in the second transport direction which is the reverse direction of the first transport direction by not less than a sixth distance as a distance obtained by subtracting a fourth distance from a fifth distance as a distance obtained by subtracting the third distance from the first distance if it is judged that the recording medium is not sheet-shaped.

In the present invention, the vicinity of the backward end of the recording medium in the first transport direction (position disposed within the fifth distance L5 in the first transport direction from the second position) is subjected to the printing with the nozzles which are not disposed in the vicinity of the most downstream side in the first transport direction (nozzles which are separated from the third position by not less than sixth distance L6 in the second transport direction opposite to the first transport direction). Therefore, the forward ends of the recording medium and the first tray in the first transport direction are not separated from the third position by not less than the third distance L3 toward the downstream side in the first transport direction. In other words, the thick recording medium (the first tray) are not unnecessarily separated from the nozzles toward the downstream side in the first transport direction.

Further, in the present invention, the vicinity of the backward end in the first transport direction is subjected to the image recording by means of the specified nozzles, and those other than the vicinity of the backward end are subjected to the image recording by means of arbitrary nozzles. Therefore, the image can be recorded on the entire area of the recording medium.

BRIEF DESCRIPTION OF THE DRAWINGS

FIGS. 10A and 10B show plan views schematically illustrating relative positions of recording media and nozzles 301 in respective passes in the recording process, wherein FIG. 10A shows a case in which the transport amount of the recording medium is constant, and FIG. 10B shows a case in which two types of transport amounts are provided for the recording medium.

FIG. 11 shows a table illustrating the fourth distances L4, the sixth distances L6, usable nozzles 301, and nozzles 301 to be actually used in the first pass in relation to respective image recording positions.

FIGS. 12A, 12B and 12C show vertical sectional views of the multifunction machine 1 schematically illustrating the positional relationship among the image recording section 24, the media tray 71, and an interference member, wherein FIG. 12A shows a case in which the interference member is a wall surface 53 for constructing the back surface of the multifunction machine 1, FIG. 12B shows a case in which the interference member is an outer guide surface 29, and FIG. 12C shows a case in which the interference member is a manual feed tray 56 fixed to the wall surface 53.

FIGS. 13A and 13B show vertical sectional views of the multifunction machine 1 schematically illustrating the positional relationship among the image recording section 24, the media tray 71, and the interference member, wherein FIG. 13A shows a case in which the interference member is a scanner casing 8, and FIG. 13B shows a case in which the interference member is a rotatable manual feed tray 56.

DESCRIPTION OF THE PREFERRED EMBODIMENTS

An embodiment of the present teaching will be explained below appropriately with reference to the drawings. The embodiment described below is merely an example of the present teaching. It goes without saying that the embodiment of the present teaching can be appropriately changed within a scope or range without changing the gist or substance of the present teaching.

Figure 1:
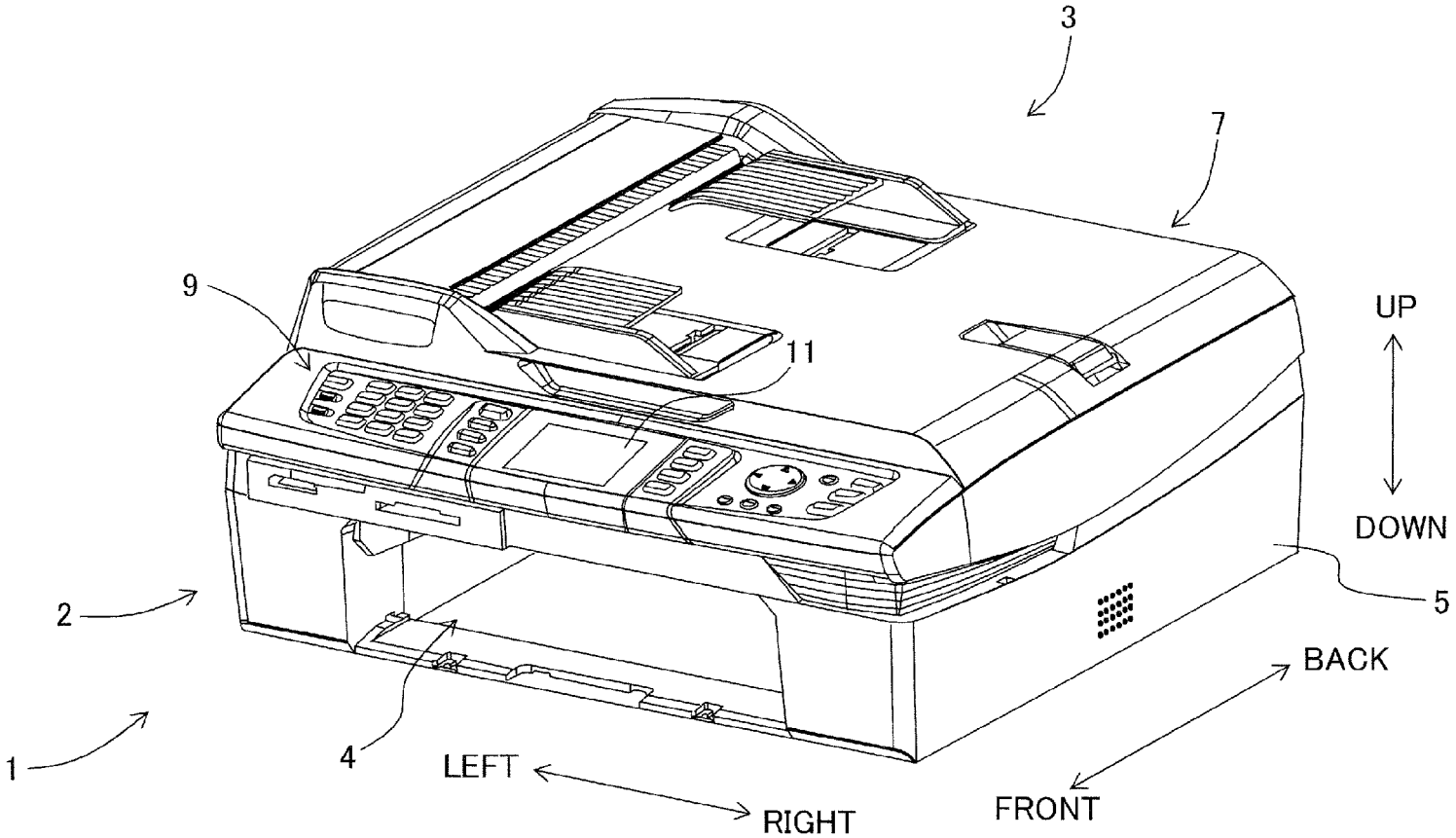
FIG. 1 shows a perspective view illustrating an appearance of a multifunction machine 1 as an exemplary embodiment of the present invention.

In this embodiment, as shown in FIG. 1, the left-right direction, the upward-downward direction, and the front-back direction as viewed in FIG. 1 are defined as the width direction, the height direction, and the depth direction of a multifunction machine 1 respectively.

The multifunction machine 1 is a multi function device (MFD) integrally provided with, for example, a printer section 2 which is arranged at a lower portion, and a scanner section 3 (corresponding to the image reading section as an example of the movable portion of the present invention) which is arranged over or above the printer section 2. The scanner section 3 is provided with a manuscript cover 7 which is disposed at an upper portion thereof and which is provided as a top plate of the multifunction machine 1. The multifunction machine 1 has, for example, the printer function, the scanner function, the copy function, and the facsimile function. For example, the scanner function and the facsimile function are arbitrary functions when the present teaching is realized. For example, the image recording apparatus according to the present teaching may be a printer which has only the printer function.

An operation panel 9 (an example of the operating section of the present teaching) is provided on the front upper surface of the scanner section 3, at the front side of the upper surface of the multifunction machine 1 in order to operate the printer section 2 and the scanner section 3. The operation panel 9 includes various operation buttons and a liquid crystal display section 11. The multifunction machine 1 is operated by a control unit 130 (an example of the control unit of the present teaching, see FIG. 8) which integrally manages the operation of the multifunction machine 1 on the basis of the input supplied from the operation panel 9.

The scanner section 3 is constructed as a so-called flat bed scanner. The manuscript cover 7 is provided openably/closably at the upper portion of the scanner section 3. A scanner casing 8 (see FIGS. 13 and 14), which is provided with a platen glass 6 (see FIG. 14) disposed on the upper surface of the scanner casing 8 and which is provided with an image sensor (not shown) disposed under or below the platen glass 6, is provided on the lower side of the manuscript cover 7. An image of a manuscript is read by the image sensor in a state in which the manuscript is placed on the platen glass 6 and the platen glass 6 is covered with the manuscript cover 7.

The arrangement of the printer section 2 will be explained in detail below with reference to FIGS. 1 to 4. As shown in FIG. 1, the printer section 2 has a casing 5 (an example of the casing of the present teaching) which has an opening 4 formed on the front surface. The constitutive elements of the printer section 2 are arranged in the casing 5.

Figure 2:
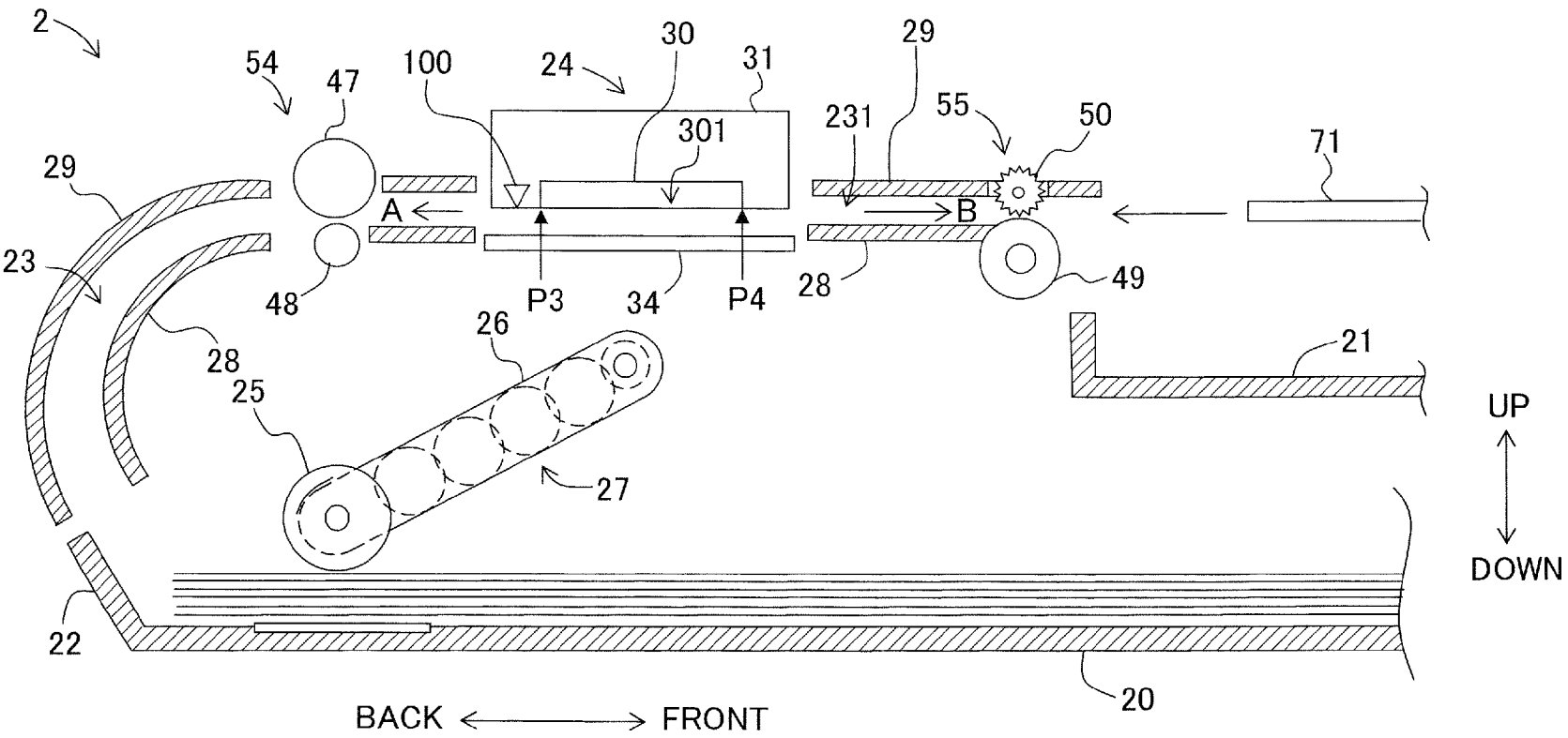
FIG. 2 shows a vertical sectional view schematically illustrating an internal structure of a printer section 2.

A paper feed tray 20 and a paper discharge tray 21 (see FIG. 2) are installed to the multifunction machine 1 via the opening 4. In FIG. 1, the paper feed tray 20 and the paper discharge tray 21 are omitted from the illustration. Recording paper sheets, which are of desired sizes including A4 size, B5 size and the like, are accommodated in the paper feed tray 20. As shown in FIG. 2, when the paper feed tray 20 is installed to the multifunction machine 1, the recording paper accommodated in the paper feed tray 20 is set so that the longitudinal direction of the recording paper is parallel to the depth direction 12 of the multifunction machine 1. The paper discharge tray 21 is arranged over or above the paper feed tray 20, and is supported by the paper feed tray 20. The paper feed tray 20 and the paper discharge tray 21 are installed to the multifunction machine 1 as the trays of two stages arranged in the up-down direction.

The multifunction machine 1 has the function to record an image on a medium surface (label) of a recording medium (an example of the recording medium of the present teaching) including, for example, CD-ROM and DVD-ROM in addition to the recording paper. This function will be described later on.

A separating inclined plate 22 is arranged on the deep side of the paper feed tray 20 installed to the multifunction machine 1. The recording paper, which is drawn out one after another from the paper feed tray 20, is separated and guided upwardly by the separating inclined plate 22.

A transport passage 23 is formed over or above the separating inclined plate 22. The transport passage 23 is bent from the upper side of the separating inclined plate 22 upwardly toward the front side of the multifunction machine 1, and the transport passage 23 is allowed to extend from the back surface side (back side) toward the front surface side (front side) of the multifunction machine 1. Further, the transport passage 22 passes through the nip point of a transport roller pair 54 (an example of the second transport section of the present teaching), the space disposed under or below an image recording section 24, and the nip point of a discharge roller pair 55 (an example of the first transport section of the present teaching), and the transport passage 22 is communicated with the paper discharge tray 21. The transport roller pair 54 includes a driving roller 47 (an example of the first roller of the present teaching) and a pinch roller 48 (an example of the second roller of the present teaching), and the discharge roller pair 55 includes a driving roller 49 and a spur roller 50. The recording paper, which is drawn out one after another from the paper feed tray 20, is guided by the transport passage 23 so that the recording paper makes a U-turn from the lower side to the upper side, and the recording paper arrives at the image recording section 24. Any image is recorded on the recording paper by means of the image recording section 24, and then the recording paper is discharged to the paper discharge tray 21. The transport passage 23 is formed by an outer guide surface 29 and an inner guide surface 28 which are opposed to one another while providing a predetermined spacing distance, except for the portion at which, for example, the image recording section 24 is arranged.

In the following description, the second transport direction 16 (corresponding to the second transport direction of the present teaching) is defined as the direction in which the recording medium such as the recording paper or the like is transported from the nip point of the transport roller pair 54 via the space disposed under or below the image recording section 24 and the nip point of the discharge roller pair 55 to the paper discharge tray 21. On the other hand, in the description, the first transport direction 15 (corresponding to the first transport direction of the present teaching) is defined as a direction opposite to the second transport direction. The first/second transport direction is the direction in which the recording medium is moved in accordance with the driving of the first transport section. In other words, the image recording section 24 is provided on the downstream side of the discharge roller pair 55 in the first transport direction 15, and the transport roller pair 54 is provided on the downstream side of the image recording section 24 in the first transport direction 15. In this embodiment, the first/second transport direction is parallel to the front-back direction.

A paper feed roller 25 is provided over or above the paper feed tray 20. The paper feed roller 25 is rotatably supported by an end portion of a paper feed arm 26 which is movable in the up-down direction so that the paper feed arm 26 can be brought in contact with or separated from the paper feed tray 20. The paper feed roller 25 is rotated by the driving force of a paper feed motor 76 (see FIG. 8) transmitted through a driving transmitting mechanism 27 including a plurality of gears meshed with each other. The paper feed roller 25 supplies the recording paper sheets stacked on the paper feed tray 20 to the transport passage 23 while separating the recording paper sheets one by one. In particular, the paper feed roller 25 is pressed onto the recording paper sheet disposed on the paper feed tray 20, and the paper feed roller 25 is rotated in this state. Accordingly, the recording paper sheet disposed at the uppermost position is moved toward the separating inclined plate 22 by means of the frictional force generated between the recording paper sheet and the roller surface of the paper feed roller 25. The front end of the recording paper sheet abuts against the separating inclined plate 22, and the recording paper sheet is guided upwardly. The recording paper sheet is fed into the transport passage 23.

The image recording section 24 is provided with a carriage 31 which carries a recording head 30 and which is reciprocatively movable in the main scanning direction (a direction which is normal to the paper surface in FIG. 2). The recording head 30 is exposed on the lower side of the carriage 31. Inks of respective colors of cyan (C), magenta (M), yellow (Y), and black (Bk) are supplied from ink tanks 32 (see FIG. 3) via ink tubes 33 (see FIG. 3).

Figure 5:
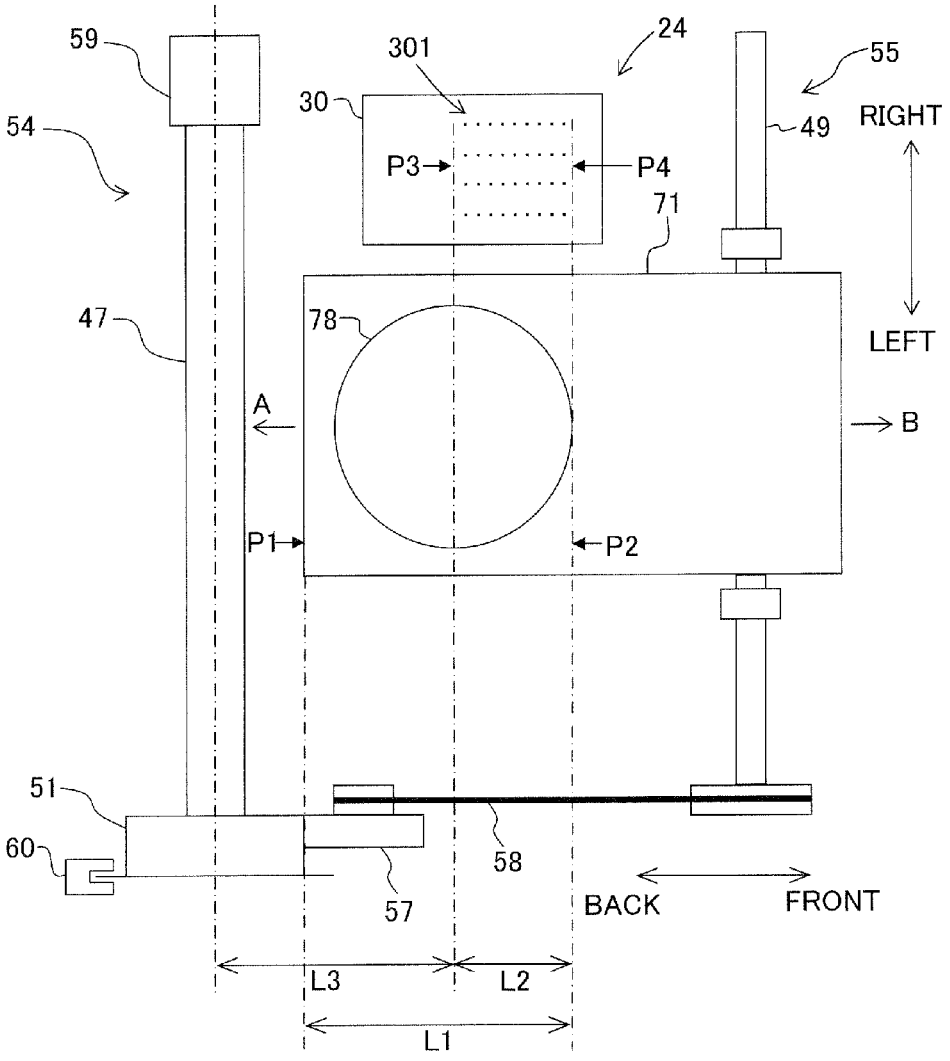
FIG. 5 shows a partial plan view of the printer section 2 schematically illustrating the positional relationship among the image recording section 24, a media tray 71, and a transport roller pair 54.

As shown in FIG. 5, a plurality of nozzles 301 (an example of the nozzles of the present teaching) are formed on the lower surface of the recording head 30. Arrays of the nozzles 301, which correspond to the color inks, are aligned in the first/second transport direction. The plurality of nozzle arrays each corresponding to one of the color inks is arranged side by side in the reciprocative movement direction of the carriage 31 (left-right direction 13). The numbers and the pitches of the nozzles 301 of the respective colors in the first/second transport direction are appropriately determined depending on, for example, the resolution of the recording image. The number of the nozzle arrays may be increased or decreased depending on the number of the color inks. In the following description, the downstream nozzle position P3 (corresponding to the third position of the present teaching) is the position disposed on the most downstream side in the first transport direction 15 in the area in which the nozzles 301 of the respective colors are formed, and the upstream nozzle position P4 (corresponding to the fourth position of the present teaching) is the position disposed on the most upstream side in the first transport direction 15 in the above described area. The distance from the downstream nozzle position to the upstream nozzle position is defined as a second distance (a nozzle length) L2 (corresponding to the second distance of the present teaching).

The recording head 30 discharges the respective inks as minute ink droplets from the nozzles 301 provided on the lower surface thereof. When the carriage 31 is reciprocatively moved in the main scanning direction, then the recording head 30 is scanned across the recording paper, and the image is recorded on the recording paper which is transported on a platen 34.

According to the above, the image recording section 24 is provided on the downstream side of the discharge roller pair 55 in the first transport direction 15. The plurality of nozzles 301 are formed over the nozzle length L2 ranging from the downstream nozzle position P3 disposed on the most downstream side in the first transport direction 15 to the upstream nozzle position P4 disposed on the most upstream side in the first transport direction 15. The image is recorded on the recording medium such as the recording paper or the like by discharging the ink droplets from the nozzles 301.

Figure 3:
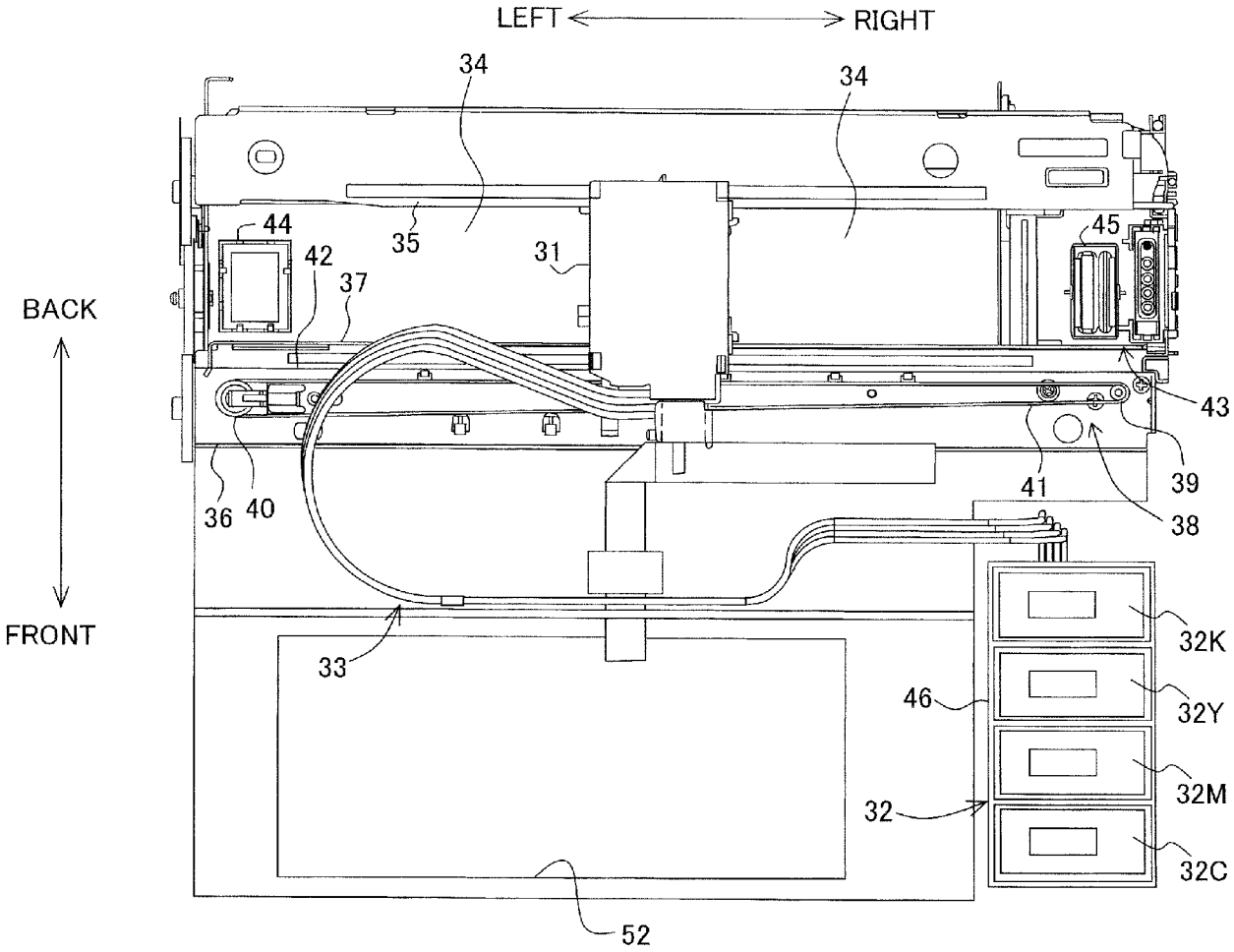
FIG. 3 shows a partial plan view illustrating the internal structure of the printer section 2.
Figure 4:
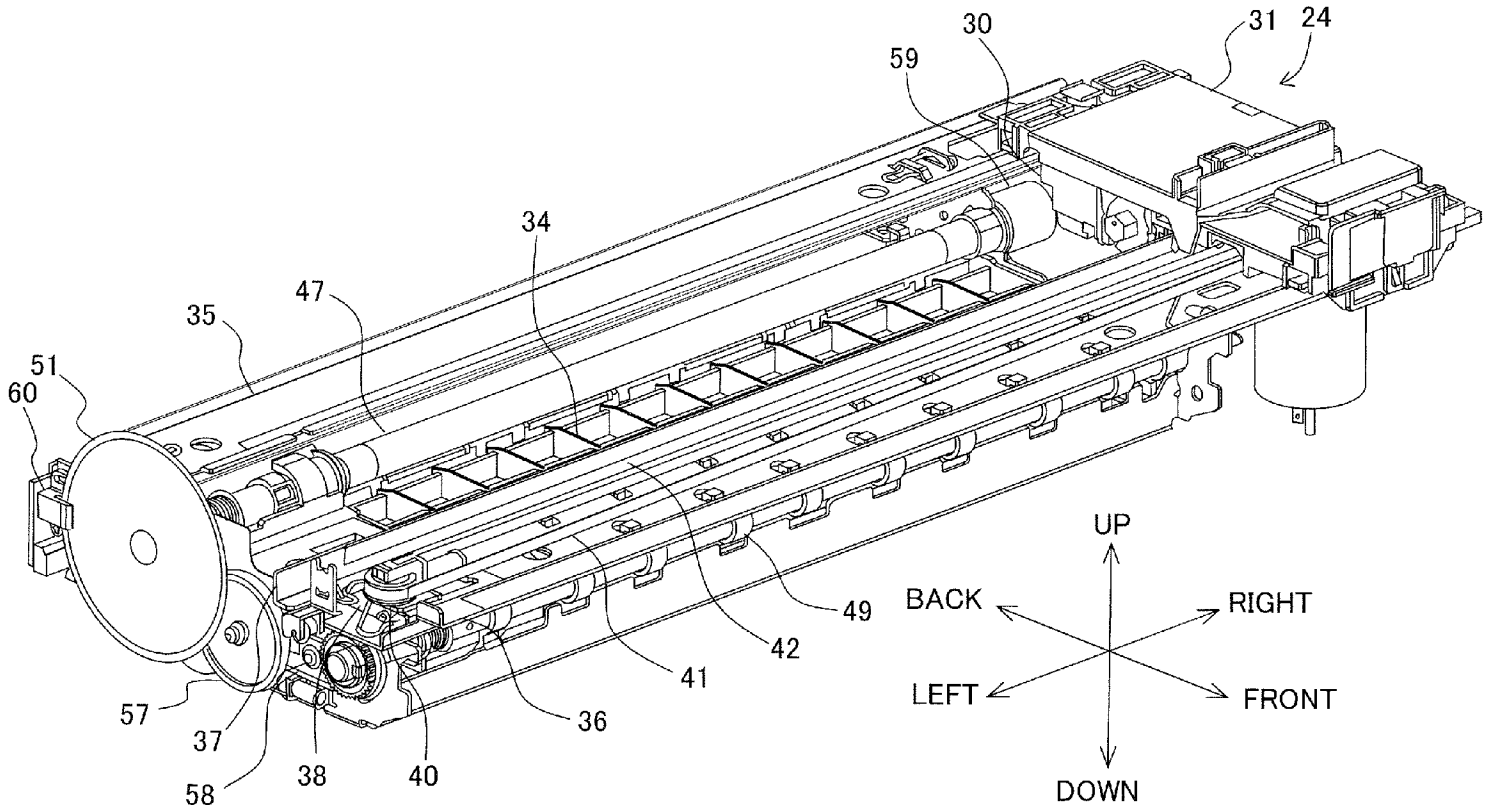
FIG. 4 shows a perspective view illustrating a mechanism of an image recording section 24.

As shown in FIGS. 3 and 4, a pair of guide rails 35, 36 are arranged on the upper side of the transport passage 23 on which the image recording section 24 is arranged. The guide rails 35, 36 are arranged while providing a spacing distance in the first/second transport direction of the recording paper, and the guide rails 35, 36 are allowed to extend in the width direction of the transport passage 23 (left-right direction 13). The carriage 31 is provided slidably in the left-right direction on the guide rails 35, 36 while striding over the guide rails 35, 36.

The guide rail 35, which is arranged on the upstream side of the recording head 30 in the direction (second transport direction 16) in which the recording paper is transported, is a flat plate-shaped member in which the length in the left-right direction thereof is longer than the scanning width of the carriage 31. The upper surface of the guide rail 35 slidably supports one end portion, of the carriage 31, disposed on the upstream side in the second transport direction 16.

The guide rail 36, which is arranged on the downstream side of the recording head 30 in the second transport direction 16, is a flat plate-shaped member in which the length in the left-right direction is substantially the same as the length of the guide rail 35. The upper surface of the guide rail 36 slidably supports the other end portion, of the carriage 31, disposed on the downstream side in the second transport direction 16. The end portion 37 of the guide rail 36, which is disposed on the upstream side in the second transport direction 16, is bent upwardly substantially at a right angle. The carriage 31 is provided with an unillustrated engaging member which is engageable with the end portion 37 of the guide rail 36 so that the end portion 37 of the guide rail 36 is nipped or pinched by the engaging member. Accordingly, the carriage 31 is slidably supported on the guide rails 35, 36. The carriage 31 can make the reciprocating movement in the left-right direction 13 on the basis of the end portion 37 of the guide rail 36 as the reference.

A belt driving mechanism 38 is arranged on the upper surface of the guide rail 36. The belt driving mechanism 38 includes a driving pulley 39 and a driven pulley 40 which are provided in the vicinity of the both ends of the transport passage 23 in the width direction 13 respectively, and an endless annular timing belt 41 which has teeth provided on the inner side and which is spanned or bridged under tension between the driving pulley 39 and the driven pulley 40. A carriage (CR) driving motor 311 (see FIG. 8) is connected to the shaft of the driving pulley 39. The driving force is inputted from the CR driving motor 311. The timing belt 41 performs the rounding motion in accordance with the rotation of the driving pulley 39. The timing belt 41 is not limited to the endless annular belt but may be an open end belt in which both end portions of the open end belt are secured to the carriage 31.

The carriage 31 is secured to the timing belt 41. The carriage 31 is reciprocatively moved on the guide rails 35, 36 with the reference of the end portion 37 in accordance with the rounding motion of the timing belt 41. The recording head 30 is carried on the carriage 31. Therefore, the recording head 30 is reciprocatively movable together with the carriage 31 in the width direction 13 of the transport passage 23 as the main scanning direction. An encoder strip 42 for a linear encoder is arranged on the guide rail 36 along the end portion 37. The linear encoder detects the encoder strip 42 by means of a photointerrupter (not shown). The reciprocating movement of the carriage 31 is controlled on the basis of the detection signal of the linear encoder.

As shown in FIGS. 2 to 4, the platen 34 is arranged to face the recording head 30 under or below the transport passage 23. The platen 34 is arranged to cover a central portion of the reciprocating movement range of the carriage 31 through which the recording paper is allowed to pass. The width of the platen 34 is sufficiently larger than the maximum with of any recording paper which can be transported. Therefore, the both ends in the width direction of the recording paper always pass on the platen 34.

As shown in FIG. 3, a purge mechanism 43 and a waste ink tray 44 are arranged at an area which is separated away from the image recording range available for the recording head 30, i.e., the purge mechanism 43 and the waste ink tray 44 are arranged within the ranges disposed on the both sides of the platen 34 through which the recording paper does not pass. The purge mechanism 43 sucks and removes bubbles and foreign matters together with the inks, for example, from the nozzles of the recording head 30. The purge mechanism 43 is provided with a cap 45 which covers the nozzle surface of the recording head 30. When the bubbles or the like contained in the recording head 30 are sucked and removed, the carriage 31 is moved so that the recording head 30 is positioned over the cap 45. The cap 45 is moved upwardly in this state, and the cap 45 is brought in tight contact so that the nozzles 301, which are disposed on the lower surface of the recording head 30, are tightly closed. The inks are sucked from the nozzles 301 of the recording head 30 by means of a pump (not shown) connected to the cap 45.

The waste ink tray 44 is arranged on the side opposite to the purge mechanism 43 at the area which is away from the image recording range available for the carriage 31. The waste ink tray 44 receives the inks discharged by the idle discharging (idle jetting) from the recording head 30. The idle discharging is referred to as "flashing".

As shown in FIG. 3, the ink tanks 32 are accommodated in ink tank accommodating sections 46 provided on the right side of the front surface in the casing 5 of the printer section 2. In particular, the ink tanks 32 include four ink tanks 32C, 32M, 32Y, 32K for storing the respective color inks of cyan (C), magenta (M), yellow (Y), and black (Bk). The inks are supplied from the ink tanks 32 to the carriage 31 via the ink tubes 33 provided for the respective colors.

As shown in FIGS. 2 and 4, the transport roller pair 54 is provided on the upstream side of the image recording section 24 in the second transport direction 16. The transport roller pair 54 is provided as an integrated unit including the driving roller 47 and the pinch roller 48 provided to make contact with the driving roller 47 under the driving roller 47. When the driving roller 47 is driven and rotated forwardly, then the recording paper, which is fed from the paper feed tray 20, is interposed by the driving roller 47 and the pinch roller 48, and the recording paper is transported onto the platen 34 disposed on the downstream side in the second transport direction 16.

The discharge roller pair 55, which has the driving roller 49 and the spur roller 50 provided over the driving roller 49, is provided on the downstream side of the image recording section 24 in the second transport direction 16. The recording paper, on which the image has been printed, is interposed by the driving roller 49 and the spur roller 50. The recording paper is transported in the direction (second transport direction 16) in which the recording paper is discharged to the paper discharge tray 21 by the driving roller 49 forwardly rotating. When the driving roller 49 is driven and rotated reversely, a media tray 71 (an example of the first tray of the present teaching) described later on is transported in the first transport direction 15. The spur roller 50 is pressed onto the recording paper on which the recording has been completed. Therefore, the roller surface is formed with spur-shaped protrusions and recesses so that the image, which has been recorded on the recording paper, is not deteriorated.

As shown in FIGS. 4 and 5, the driving roller 47 is driven and rotated by the driving force transmitted from a transport motor 59 (an example of the driving source of the present teaching) connected to one end in the axial direction of the driving roller 47. The driving roller 49 is driven and rotated by the driving force transmitted from the driving roller 47 via an intermediate gear 57 and a belt 58. The driving roller 47 and the driving roller 49 are controlled by a driving circuit incorporated into ASIC 135 (see FIG. 8) mounted on a control board 52 (see FIG. 3). The driving circuit is capable of switching the directions of rotation of the driving rollers 47, 49 into any one of the forward rotation direction and the reverse rotation direction. The switching of the direction of rotation as described above is performed in accordance with the switching control for the rotation of the transport motor 59 or the switching of the gear for transmitting the rotational force of the transport motor 59 to the rotary shaft of each of the rollers.

According to the above, the transport roller pair 54 is provided with the driving roller 47 which is driven by the transport motor 59, and the spur roller 50 which is arranged to make contact with the driving roller 47. The discharge roller pair 55 is provided with the driving roller 49 which is driven by the transport motor 59, and the spur roller 50 which is arranged to make contact with the driving roller 49.

The driving roller 47 and the driving roller 49 are driven intermittently at a predetermined line feed width by controlling the transport motor 59. The rotation of the driving roller 47 is synchronized with the rotation of the driving roller 49. As shown in FIGS. 4 and 5, a rotary encoder (not shown) detects an encoder disk 51 provided for the driving roller 47 by means of a photo-interrupter 60. The driving of the driving roller 47 and the driving of the driving roller 49 are controlled on the basis of the detection signal of the rotary encoder.

As shown in FIG. 2, the recording paper is transported in the second transport direction 16 on the platen 34 at a predetermined line feed width by means of the driving roller 47 and the driving roller 49 which are driven intermittently. The recording head 30 is subjected to the scanning every time after the line feed is performed, and the image recording is performed from the forward end side of the recording paper. The image recording is performed on a predetermined area of the recording paper by means of the recording head 30, and then the driving roller 49 is driven and rotated continuously. Accordingly, the recording paper, which is interposed by the driving roller 49 and the spur roller 50, is discharged to the paper discharge tray 21.

As described above, the multifunction machine 1 has the function to record any image on the medium surface (label) of the recording medium including, for example, CD-ROM and DVD-ROM. In this embodiment, when the image is recorded on the medium surface of the recording medium, then the recording medium is placed on the media tray 71, and the media tray 71 is inserted in the first transport direction 15 from the opening 4 of the multifunction machine 1. The multifunction machine 1 may be constructed such that the recording medium is not placed on the media tray 71, and that the recording medium itself is inserted from the opening 4 of the multifunction machine 1. In the former case, the media tray on which the recording medium such as CD-ROM and DVD-ROM has been loaded corresponds to the printing media in the present teaching. In the latter case, the recording medium itself corresponds to the printing media in the present teaching.

Figure 6:
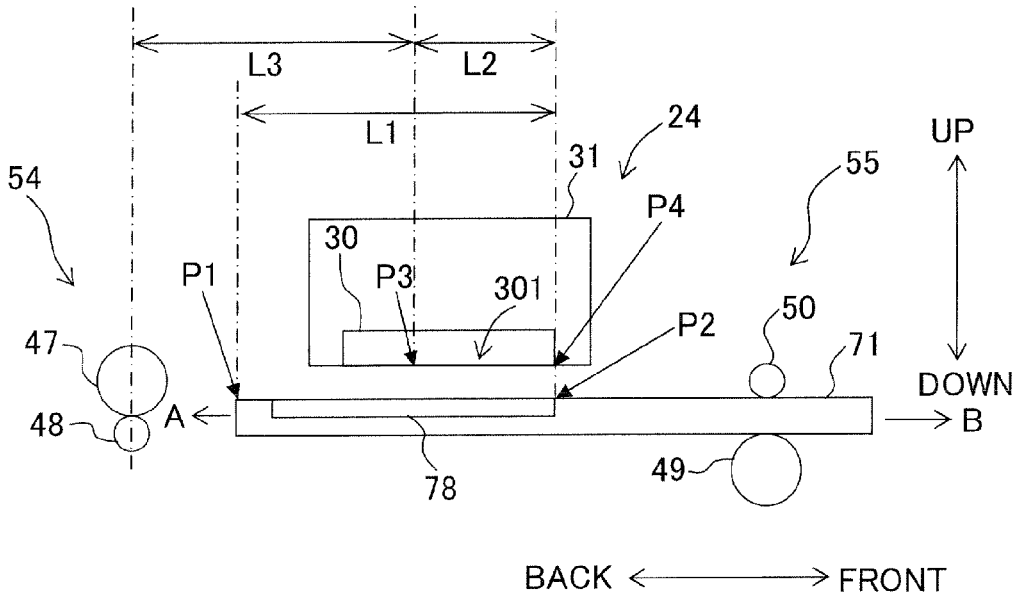
FIG. 6 shows a vertical sectional view of the printer section 2 schematically illustrating the positional relationship among the image recording section 24, the media tray 71, and the transport roller pair 54.

As shown in FIGS. 5 and 6, the media tray 71 is composed of a substance such as a resin having a high rigidity. The thickness of the media tray 71 (length in the up-down direction (height direction)) is several millimeters (for example, 2 mm to 3 mm). Further, the length of the media tray 71 in the first/second transport direction (depth direction 12) and the length in the width direction are longer than the thickness of the media tray 71 (length in the height direction), and the length in the first/second transport direction (depth direction 12) is longer than the length in the width direction 13. In other words, the media tray 71 is a thin rectangular parallelepiped or a thin rectangular cuboid. A media loading portion 78, which is a circular recess for loading or placing the recording medium thereon, is provided on the upper surface of the media tray 17.

In the following description, the forward end of the media tray 71 in the first transport direction 15 is designated as the media forward end position P1 (corresponding to the first position of the present teaching). When the recording medium is placed on the media tray 71 while protruding in the first transport direction 15, the forward end of the recording medium in the first transport direction 15 is designated as the media forward end position P1. The backward end in the first transport direction 15 of the image recording range for recording the image on the recording medium placed on the media tray 71 is designated as the printing backward end position P2 (corresponding to the second position of the present teaching). The distance between the media forward end position P1 and the printing backward end position P2 is designated as the first distance (effective media length) L1 (corresponding to the first distance of the present teaching). When the image is recorded while allowing any blank space to remain at the backward end in the first transport direction 15 of the recording medium, the backward end in the first transport direction 15 of the image recording range except for the blank space is designated as the printing backward end position P2. In this way, the effective media length L1 corresponds to the length obtained by adding the length from the end in the first transport direction of the image recording range to the media forward end position P1 to the length of the image recording range for recording the image in relation to the recording medium placed on the media tray 71.

As shown in FIG. 2, when the media tray 71, in which the recording medium is loaded on the media loading portion 78, is inserted in the first transport direction 15, i.e., from the opening 4 formed on the front surface of the multifunction machine 1 toward the straight portion 231 of the transport passage 23, then the insertion of the media tray 71 is detected by an unillustrated sensor, and the driving roller 49 is controlled to drive reversely. Accordingly, the media tray 71 is transported to a predetermined position in the first transport direction 15.

The predetermined position is the position at which the forward end of the media tray 17 in the first transport direction 15 is not brought in contact with an interference member as explained below. For example, the predetermined position is a position separated by a preset distance in the second transport direction 16 from the position at which the forward end of the media tray 71 is brought in contact with the interference member (corresponding to the interference member of the present teaching). At the same time, the predetermined position is the position at which the backward end in the first transport direction of the image recording range of the recording medium placed on the media tray 71 is opposed to any one of the nozzles 301 formed on the recording head 30.

The interference member is one of various constitutive elements arranged for the multifunction machine 1. The interference member is provided at the position separated from the downstream nozzle position P3 in the first transport direction 15 by the third distance (separation distance) L3 (corresponding to the third distance of the present teaching). The separation distance L3 is shorter than the effective media length L1, and the total of the separation distance L3 and the nozzle length L2 is larger than the effective media length L1. In other words, the relationship among the effective media length L1, the nozzle length L2, and the separation distance L3 resides in L3<L1<L2+L3. The separation distance L3 is herein defined as the distance in the first/second transport direction of the media tray 71. There is provided L3<L1. Therefore, if it is intended to transport the media tray 71 in the first transport direction 15 until the printing backward end position P2 of the media tray 71 and the downstream nozzle position P3 are coincident with each other, the forward end of the media tray 71 abuts against the interference member. Further, there is provided L1<L2+L3. Therefore, if the media tray 71 is arranged so that the media forward end position P1 of the media tray 71 abuts against the interference member, the printing backward end position P2 of the media tray 71 is positioned in the printing area between the downstream nozzle position P3 and the upstream nozzle position P4. When the effective media length L1 equals to the sum of L2 and L3 (L1=L2+L3) and when it is intended to transport the media tray 71 in the first transport direction 15 until the printing backward end position P2 of the media tray 71 and the downstream nozzle position P3 are coincident with each other, the forward end of the media tray 71 just abuts against the interference member. Therefore the effective media length L1 can not be set to a length that is not less than L2+L3. In this embodiment of the media tray 71, the interference member is the transport roller pair 54. In other words, as shown in FIGS. 5 and 6, the distance, which ranges from the downstream nozzle position P3 to the nip point of transport roller pair 54 (the driving roller 47 and the pinch roller 48), is the separation distance L3. In this embodiment, there is provided "separation distance L3>nozzle length L2".

When the media tray 17 is transported to the predetermined position, then the driving roller 49 is once stopped, and then the rotational direction of the driving roller 49 is switched into the forward rotation. Accordingly, the media tray 71 is transported in the second transport direction 16. The recording medium, which is placed on the media tray 71, is allowed to pass over the platen 34 while being transported in the second transport direction 16. The ink droplets are discharged from the predetermined nozzles of the recording head 30 onto the recording medium transported onto the platen 34 depending on the position of the recording of the image on the recording medium as described later on. Accordingly, the image is recorded on the medium surface of the recording medium, and the media tray 71 is finally discharged from the paper discharge tray 21.

As shown in FIG. 2, the multifunction machine 1 is provided with a media sensor 110 (an example of the detecting section of the present teaching) in order to sense or detect the recording medium which is inserted from the opening 4 of the multifunction machine 1 and which is transported in the first transport direction 15 through the transport passage 23. The media sensor 110 is provided on the lower surface of the carriage 34 at an area located in the vicinity of the most downstream side in the first transport direction 15. The media sensor 110 includes a light-emitting portion (not shown) which is formed of for example, a light emitting diode, and a light-receiving portion (not shown) which is formed of, for example, an optical sensor. The light-emitting portion of the media sensor 110 emits the light downwardly, and the reflected light, which is reflected by the media tray 71, the recording medium, or the platen 34, is received by the light-receiving portion.

An explanation will be made below about the detection of the position of the recording medium (circular CD or DVD) by means of the media sensor 110.

The media sensor 110 is subjected to the scanning together with the carriage 31. When the carriage 31 is subjected to the scanning in a state in which the recording medium is loaded on the platen 34, the media sensor 110 receives the reflected light from the upper surface of the platen 34, the upper surface of the media tray 71, or the upper surface of the recording medium during the process of the scanning.

When the upper surfaces of the platen 34 and the media tray 71 are allowed to have a color such as a black color or the like having a low reflectance, the detected amount of light, which is obtained by the light-receiving portion in accordance with the reflected light from the recording medium, is different from the detected amount of light which is obtained by the light-receiving portion in accordance with the reflected light from the platen 34 or the media tray 71. The detected amount of light obtained by the light-receiving portion is sent to the control unit 130. Accordingly, the control unit 130 obtains the data concerning the positions of the both ends of the recording medium in the scanning direction.

Subsequently, the media tray 71 is slightly transported in the first transport direction 15, and then the above described process is executed in the same manner. The control unit 130 obtains the data about the positions of the both ends of the recording medium in the scanning direction. Accordingly, the control unit 130 has obtained the data about the four end portions of the recording medium 4. The center and the diameter of the circle can be calculated on condition that at least three points on the circumference are clarified. Therefore, the control unit 130 can determine the current position of the center of the circular recording medium on the basis of the data about the four end portions.

When the media sensor 110 detects the recording medium, the media sensor 110 detects the area within the separation distance L3 in the second transport direction 16 from the media forward end position P1. For example, the media sensor 110 determines the position of the forward end or the vicinity of the forward end of the recording medium transported in the first transport direction 15. Or, when the media sensor 110 determines the position of the media tray 71 as described later on, the media sensor 110 detects the forward end or the vicinity of the forward end of the media tray 71.

When the color of the platen 34 is different from the color of the media tray 71, the detected amount of light, which is obtained by the light-receiving portion in accordance with the reflected light from the platen 34, is different from the detected amount of light which is obtained by the light-receiving portion in accordance with the reflected light from the media tray 71. Accordingly, the control unit 130 can obtain the data about the position of the media tray 71.

Figure 8:
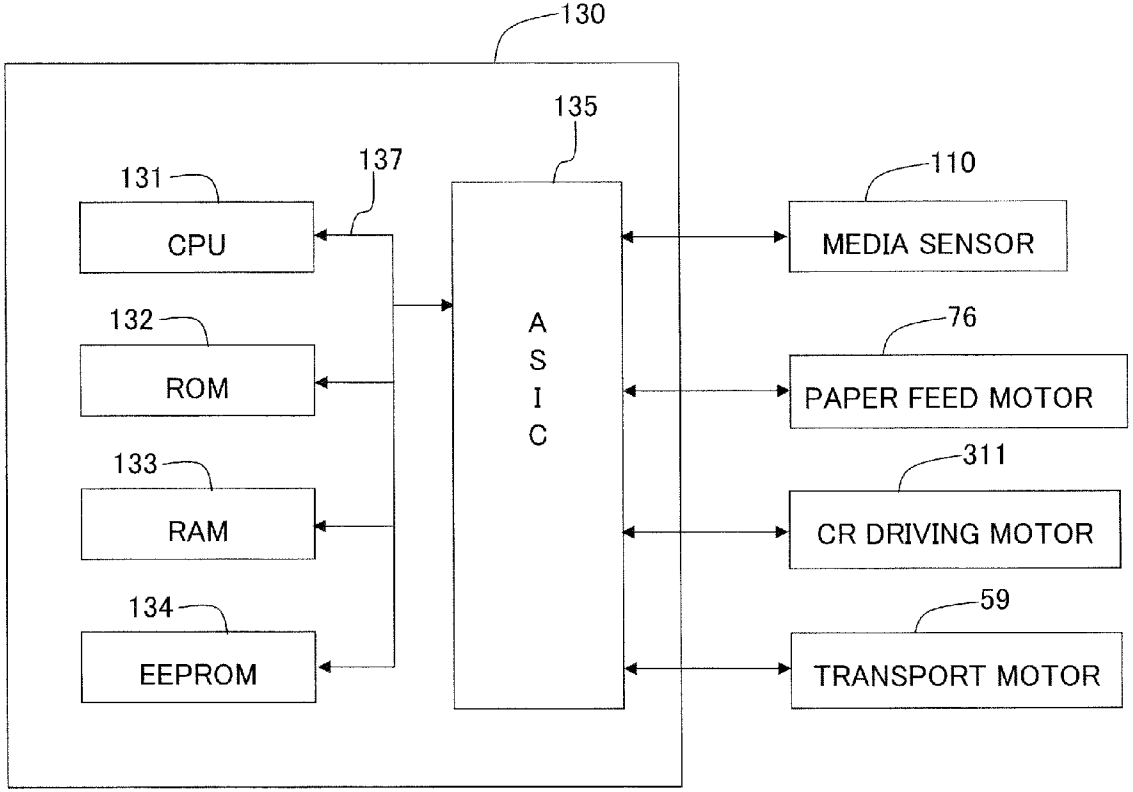
FIG. 8 shows a block diagram illustrating an arrangement of a control unit 130.

A schematic arrangement of the control unit 130 will be explained below with reference to FIG. 8. The present teaching is realized by controlling the recording by the control unit 130 in accordance with a flow chart as described later on.

The control unit 130 controls the overall operation of the multifunction machine 1. The control unit 130 is constructed as a microcomputer principally including CPU 131, ROM 132, RAM 133, EEPROM 134, and ASIC 135. These components are connected by an internal bus 137.

ROM 132 stores, for example, the program for controlling various operations of the multifunction machine 1 by CPU 131. RAM 133 is used as a storage area for temporarily recording, for example, the data and the signal used when CPU 131 executes the program or a working area for the data processing. EEPROM 134 stores, for example, the setting and the flag to be retained even after the power source is turned OFF.

For example, the media sensor 110, the paper feed motor 76, the CR driving motor 311, and the transport motor 59 are connected to ASIC 135. The driving circuits, which control the motors, are incorporated into ASIC 135 corresponding to the motors. When the driving signal, which is provided to rotate each of the motors, is inputted from CPU 131 into the driving circuit corresponding to the predetermined motor, the driving current, which corresponds to the driving signal, is outputted from the driving circuit to the corresponding motor. Accordingly, the corresponding motor is rotated forwardly or reversely at a predetermined speed of rotation.

The media sensor 110 outputs the analog electric signal (voltage signal or current signal) depending on the amount of light received by the light-receiving portion. The output signal of the light-receiving portion is input into the control unit 130. The control unit 130 judges whether or not the electrical level thereof (voltage value or current value) is not less than a predetermined threshold value. For example, if the electrical level of the input signal is not less than the predetermined threshold value, the signal is judged to be the HIGH level signal (signal brought about by the reflected light from the recording medium). If the electrical level of the input signal is less than the predetermined threshold value, the signal is judged to be the LOW level signal (signal brought about by the reflected light from the platen 34 or the media tray 71).

Figure 7:
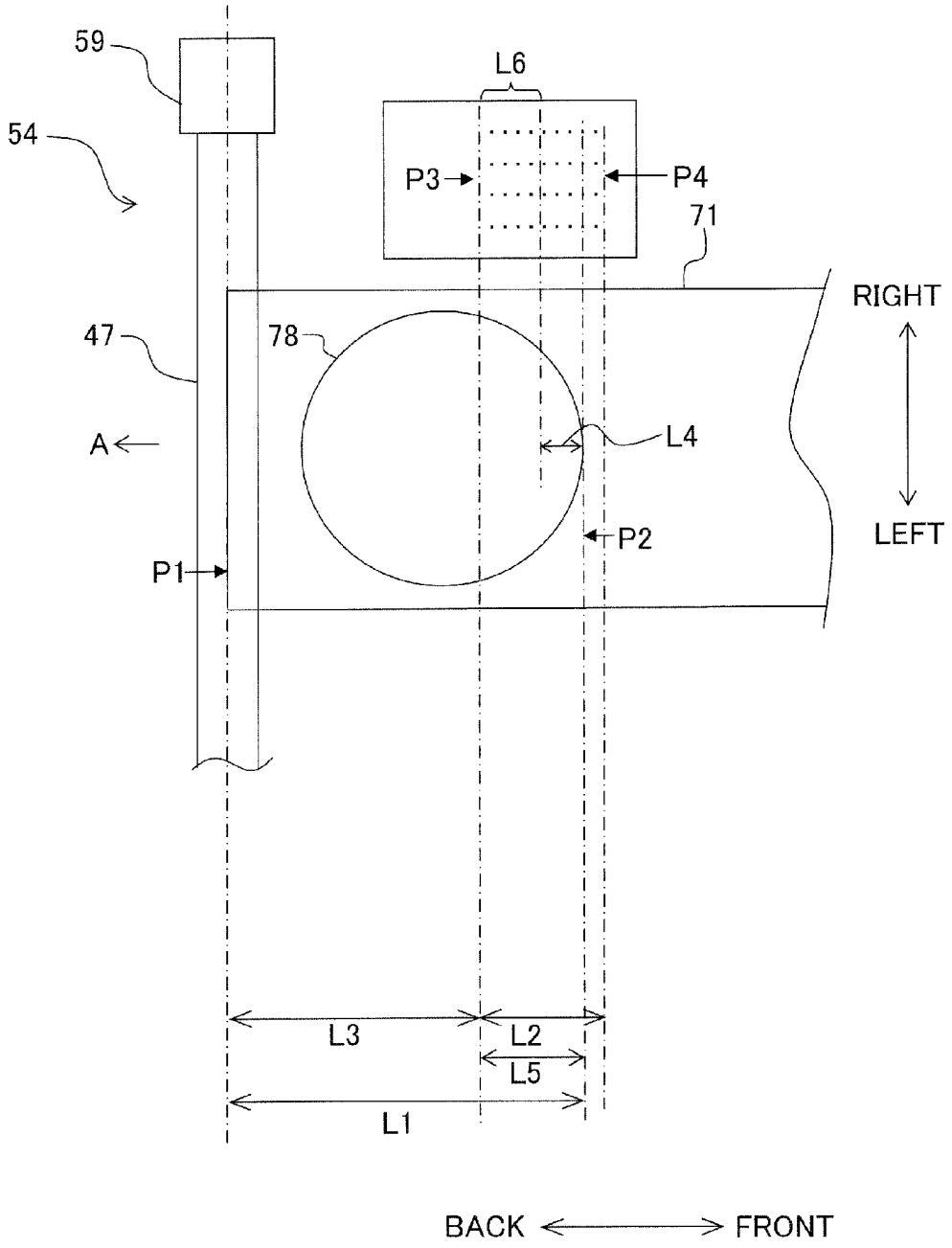
FIG. 7 shows a partial plan view illustrating the printer section 2 to depict a fourth distance L4, a fifth distance L5, and a sixth distance L6.

As shown in FIG. 7, the fourth distance L4 is defined as the distance between the image recording position on the most downstream side in the first transport direction and the printing backward end position P2 in the image recording range with respect to the recording medium. The fifth distance L5 is defined as the distance obtained by subtracting the third distance (separation distance) L3 from the first distance (effective media length) L1, and the sixth distance L6 is defined as the distance obtained by subtracting the fourth distance L4 from the fifth distance L5. The fourth distance L4, the fifth distance L5, and the sixth distance L6 correspond to the fourth distance, the fifth distance, and the sixth distance of the present teaching respectively. The fifth distance L5 corresponds to the length of the overlapping portion of the media tray 71 when the media tray 71 is positioned to abut against the interference member (transport roller pair 54), wherein the overlapping portion of the media tray 71 is an area of the media tray 71 between the media forward end position P1 and the printing backward end position P2, and has an overlap with the nozzle array. The sixth distance L6 corresponds to the length of the portion of the nozzle array not used in the printing for the area of the fourth distance L4 from the printing backward end position P2 of the media tray 71, as described later on. In this arrangement, the recording process (an example of the ink-jet recording method of the present teaching) is performed by the control unit 130 in the printer section 2 constructed as described above, wherein the recording section 24 is controlled so that a part of the nozzles 301, which are separated from the third position (downstream nozzle position) P3 in the second transport direction 16 by not less than the sixth distance L6, are used for the concerning image recording position when the fourth distance L4 is less than the fifth distance L5. An explanation will be made below about a process procedure of the recording process on the basis of the flow chart shown in FIG. 9.

When the image recording instruction is input into the multifunction machine 1, it is judged whether the image recording instruction is directed to the recording medium or to the recording paper (S10, an example of the first step of the present teaching). For example, when the image recording instruction is input by operating the operation panel 9 after the media tray 71, on which the recording medium is placed, is inserted in the first transport direction 15 from the opening 4, it is judged that the concerning image recording instruction is directed to the image recording on the recording medium. In another case, when it is designated with the operation panel 9 that the image should be recorded on the recording medium not on the recording paper, it is also judged that the concerning image recording instruction is directed to the image recording on the recording medium. It may be judged that the image recording instruction is directed to the image recording on the recording medium, when the inserted recording medium or the media tray 71 is detected by the media sensor 110.

If it is judged in Step S10 that the image recording instruction is not directed to the recording medium but the image recording instruction is directed to the recording paper (S10: No), the first image recording process is executed (S20), in which the image recording is performed by using arbitrary nozzles. In Step S20, the paper feed roller 25 is rotated, the recording paper disposed on the paper feed tray 20 is fed to the transport passage 23, and the recording paper is transported to the position disposed under the recording section 24 by the aid of the transport roller pair 54. In other words, the recording paper is transported in the second transport direction 16. The image is recorded on the recording paper in the recording section 24. In this procedure, the image may be recorded on the recording paper with any nozzles 301 of the plurality of provided nozzles 301 irrelevant to the image recording position of the recording paper. In other words, when the sheet-shaped recording medium such as the recording paper is transported in the second transport direction 16 by the transport roller pair 54, the control unit 130 controls the recording section 24 so that the printing is performed by using a combination of the nozzles to be used and the transport amount to provide the best balance concerning the image quality and the printing speed without providing any special limitation in relation to the nozzles to be used. An example of the image recording on the recording paper will be described in detail below with reference to FIG. 10A.

Figure 10A:
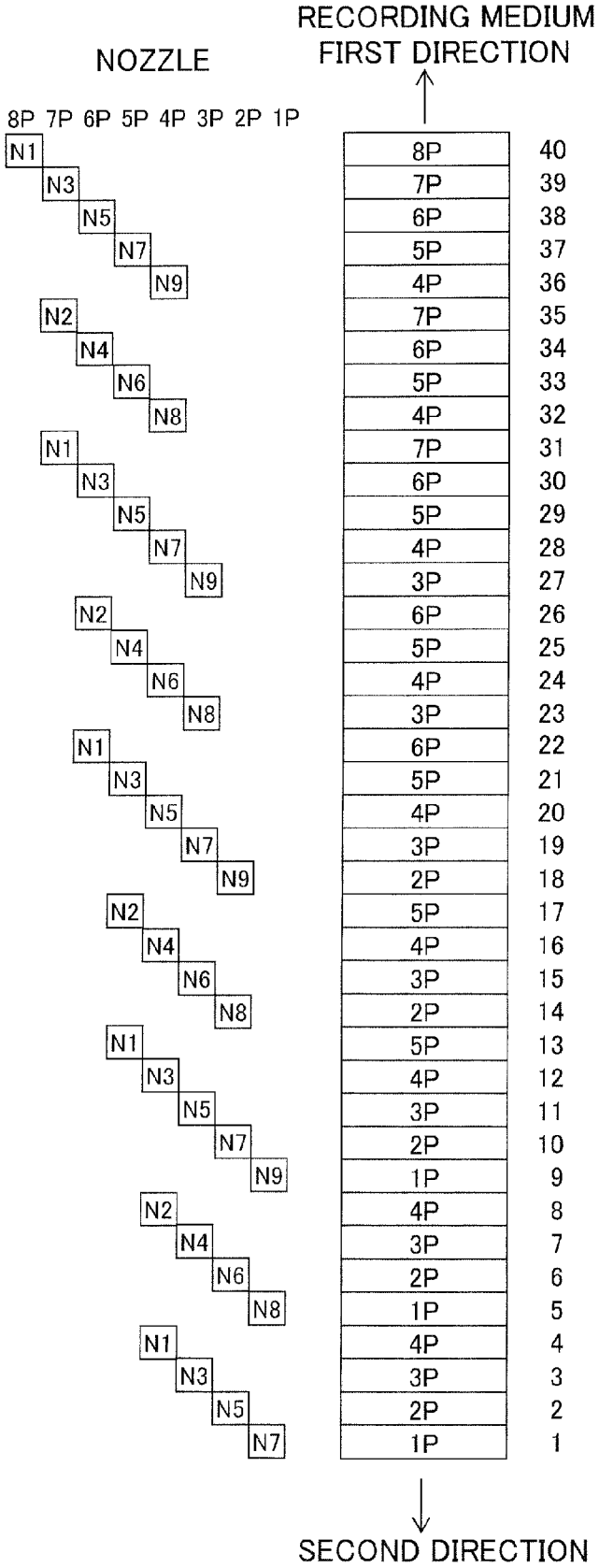
Figure 10B:
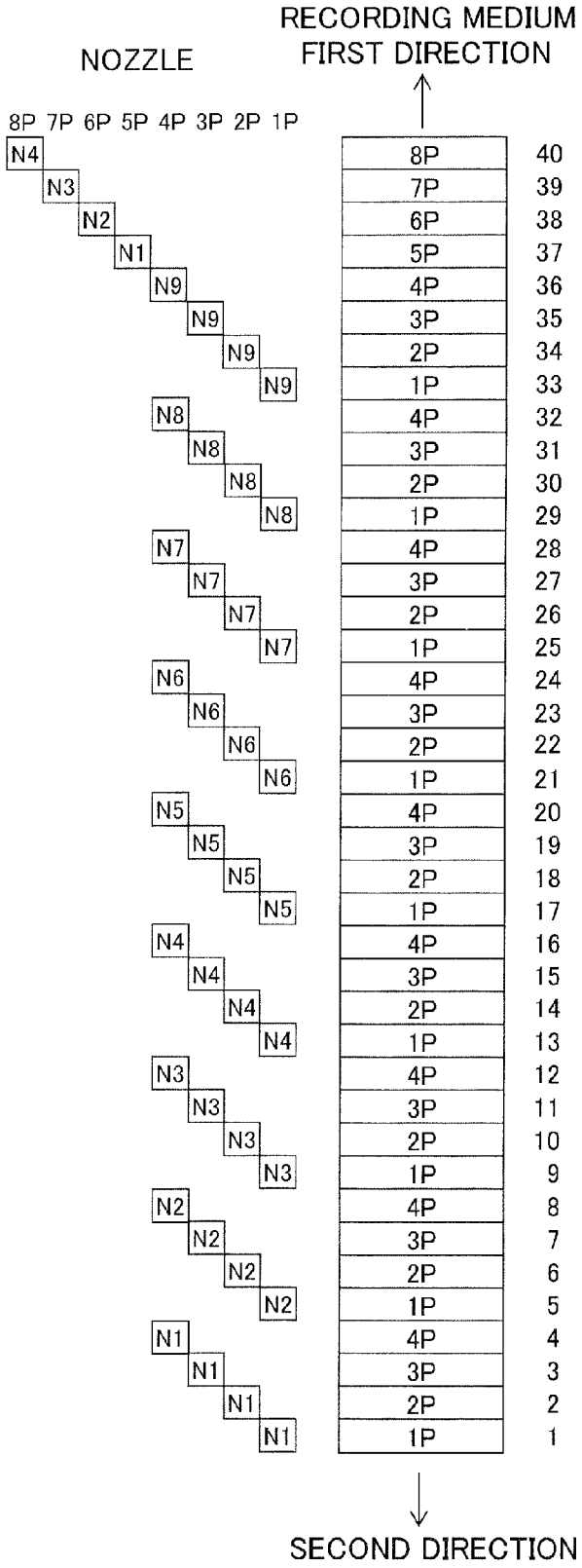

In the explanation of FIGS. 10A and 10B described later on, the unit of one scanning, in which the image recording is performed with the carriage 31 while discharging the ink droplets from the nozzles 301, is referred to as "pass (P)". For example, in FIGS. 10A and 10B, the first pass is referred to as "1P", and the second pass is referred to as "2P".

The recording paper and the recording medium are depicted on the respective right sides in FIGS. 10A and 10B, respectively. When the image recording is performed, the recording paper and the recording medium are transported in the second transport direction 16, i.e., from the upper side to the lower side of the paper surface of FIGS. 10A and 10B. Raster numbers of 1 to 40 are affixed on each of the right sides of the recording paper and the recording medium. For the convenience of explanation, it is assumed that the length of the recording paper in the first/second transport direction is the length corresponding to 40 rasters. Pass numbers are affixed to the respective rasters of the recording paper. This indicates that the concerning raster is subjected to the image recording in the pass of the corresponding pass number affixed to the concerning raster.

For the convenience of explanation, in FIGS. 10A and 10B, it is assumed that the recording is performed with only one color on the recording paper and the recording medium, and nine nozzles 301 are provided on the recording section 24. The respective nozzles are referred to as N1 to N9. The position of the nozzle N1, which is disposed on the most downstream side in the second transport direction 16, is the fourth position P4, and the position of the nozzle N9, which is disposed on the most upstream side in the second transport direction 16, is the third position P3. The relative positions of the nozzles 301 with respect to the recording paper and the recording medium in the respective passes are depicted on the respective left sides in FIGS. 10A and 10B. For example, in FIG. 10A, in the first pass, the nozzle N7 is positioned over the 1st raster of the recording paper, the nozzle N8 is positioned over the 5th raster of the recording paper, and the nozzle N9 is positioned over the 9th raster of the recording paper. It is assumed that the pitch of each nozzle is the length corresponding to the amount of 4 rasters. In other words, the image is generated on the recording paper and the recording medium at a resolution of ¼ of the pitch unit by recording the image by the recording section 24.

When the image recording is started, the positions of the nozzles 301 with respect to the recording paper are the positions of the first pass (1P) as shown in FIG. 10A. The CR driving motor 311 is driven in this state, and the ink droplets are selectively discharged from the nozzles 301 on the basis of the printing data. In the first pass, the ink droplets are discharged from the nozzles N7 to N9 onto the 1st raster, the 5th raster, and the 9th raster of the recording paper. In the actual ink-jet printer, for example, the nozzle pitch is 1/300 inches and the resolution of the transportation (corresponding to 1 raster) of the paper is 1/7200 inches. The resolution of the transportation of the paper (1/7200 inches) corresponds to the resolution of the rotary encoder used for controlling the transport value of the transporting rollers.

When the image recording in the first pass is completed, then the CR driving motor 311 is stopped, the transport motor 59 is driven, and the driving roller 47 is rotated in a predetermined amount. Accordingly, the recording paper is transported in the second transport direction 16 in a transport amount corresponding to the 9 rasters, and then the recording paper is stopped. Whether or not the amount of rotation of the driving roller 47 arrives at the concerning transport amount is judged on the basis of the pulse signal of the rotary encoder.

When the recording paper is stopped, then the CR driving motor 311 is driven again, and the ink droplets are selectively discharged from the nozzles 301 on the basis of the printing data. In the second pass, the ink droplets are discharged from the nozzles N5 to N9 onto the 2nd raster, the 6th raster, the 10th raster, the 14th raster, and the 18th raster of the recording paper. The same or equivalent procedure is also performed in the third pass and the followings. In this way, the discharge of the ink droplets from the nozzles 301 and the transport of the recording paper in the second transport direction 16 by the driving roller 47 are alternately performed. Accordingly, the image is successively recorded on the recording paper from the forward end to the backward end thereof in the second transport direction 16.

If it is judged in Step S10 that the image recording instruction is directed to the recording medium (S10: Yes), and if the recording medium is inserted in Step S10, then the routine proceeds to Step S30, and the second image recording process is executed, in which the image recording is performed by using only parts of the nozzles (an example of the second step of the present teaching). If the recording medium is not inserted in Step S10, the routine proceeds to Step S30 after the media tray 71, on which the recording medium is placed, is inserted from the opening 4, and the recording medium is transported to the position disposed under the recording section 24 by the aid of the paper discharge roller pair 55.

In Step S30, the image is recorded on the recording medium by means of the recording section 24. In this procedure, the image is recorded with only parts of the nine provided nozzles 301 depending on the image recording position on the recording medium. In other words, the control unit 130 controls the recording section 24 so that parts of the nozzles are used depending on the image recording position with respect to the recording medium placed on the media tray 71 transported in the second transport direction 16 by the transport roller pair 54. An example of the image recording on the recording medium will be described in detail below on the basis of FIG. 10B.

In the explanation of FIG. 10B, it is assumed that the first distance (effective media length) L1, the second distance (nozzle length) L2, and the third distance (separation distance) L3 are represented by the numbers of rasters of the recording medium, wherein the first distance L1 is 85 raster units, the second distance L2 is 40 raster units, and the third distance L3 is 55 raster units.

The media tray 71 is detected by the media sensor 110 during the process in which the media tray 71 is inserted from the opening 4 and the media tray 71 is transported in the first transport direction to the position disposed under the recording section 24. The current image recording position on the recording medium placed on the media tray 71 is calculated on the basis of for example, the time ranging from the detection of the forward end (media forward end position P1) of the media tray 71 by the media sensor 110 to the stop of the media tray 71 and the transport speed of the media tray 71 brought about by the discharge roller pair 55. In other words, the initial image recording position on the recording medium loaded on the media tray 71 is calculated on the basis of the detection result obtained by the media sensor 110.

Specifically, it is recognized that the positions of the nozzles 301 with respect to the recording medium are the positions corresponding to the first pass (1P) shown in FIG. 10B. Further, it is recognized that the image recording range on the recording medium in the first pass (1P) ranges from the 1st raster to the 33rd raster of the recording medium. It is calculated that the initial image recording positions are disposed on the 1st, 5th, 9th, 13th, 17th, 21st, 25th, 29th, and 33rd rasters of the recording medium. The respective calculated image recording positions correspond to the image recording positions on the most downstream side in the first transport direction 15 in relation to the image recording range with respect to the recording medium.

Subsequently, the CR driving motor 311 is driven, and the ink droplets are selectively discharged from the nozzles 301 on the basis of the printing data. In this procedure, the image is recorded on the recording medium by using only certain parts of the nozzles 301 separated from the downstream nozzle position P3 in the second transport direction 16 by not less than the sixth distance L6. The sixth distance L6 is the distance obtained by subtracting the fourth distance L4 from the fifth distance L5 (30 raster units). In other words, the sixth distance L6 is 30 raster units when the initial image recording position is disposed on the 1st raster, and the sixth distance L6 is 26 raster units when the initial image recording position is disposed on the 4th raster. The sixth distances L6 for the other image recording positions are shown in FIG. 11.

According to the above, in the first pass in this embodiment, as shown in FIG. 11, when the initial image recording position is disposed on the 1st raster, the usable nozzle 301 is any one of N1, N2, and N3 as the nozzles 301 separated from the downstream nozzle position (40th raster) in the second transport direction 16 by not less than the sixth distance L6 (30 raster units). In this embodiment, when the image recording position is disposed on the 1st raster, the nozzle N1 is used. The nozzles 301 usable for the image recording at the other image recording positions and the nozzles 301 to be actually used are shown in FIG. 11.

The ink droplets are selectively discharged to the respective image recording positions by means of the usable nozzles 301 as explained above. Specifically, as shown in FIG. 10B, in the first pass, the ink droplets are discharged from the nozzle N1 to the 1st raster of the recording medium, from the nozzle N2 to the 5th raster of the recording medium, from the nozzle N3 to the 9th raster of the recording medium, from the nozzle N4 to the 13th raster of the recording medium, from the nozzle N5 to the 17th raster of the recording medium, from the nozzle N6 to the 21st raster of the recording medium, from the nozzle N7 to the 25th raster of the recording medium, from the nozzle N8 to the 29th raster of the recording medium, and from the nozzle N9 to the 33rd raster of the recording medium.

When the image recording in the first pass is completed, then the CR driving motor 311 is stopped, the transport motor 59 is driven, and the driving roller 47 is rotated in a predetermined amount. Accordingly, the recording medium is transported in the second transport direction 16 in a transport amount corresponding to one raster unit, and then the recording medium is stopped. Whether or not the amount of rotation of the driving roller 47 arrives at the concerning transport amount is judged on the basis of the pulse signal of the rotary encoder.

When the recording medium is stopped, then the CR driving motor 311 is driven again, and the ink droplets are selectively discharged from the nozzles 301 on the basis of the printing data. As shown in FIG. 10B, in the second pass, the ink droplets are discharged from the nozzle N1 onto the 2nd raster of the recording medium, from the nozzle N2 onto the 6th raster of the recording medium, from the nozzle N3 onto the 10th raster of the recording medium, from the nozzle N4 onto the 14th raster of the recording medium, from the nozzle N5 onto the 18th raster of the recording medium, from the nozzle N6 onto the 22nd raster of the recording medium, from the nozzle N7 onto the 26th raster of the recording medium, from the nozzle N8 onto the 30th raster of the recording medium, and from the nozzle N9 onto the 34th raster of the recording medium. The same or equivalent process is also executed in the third pass and the fourth pass. However, when the routine proceeds from the fourth pass to the fifth pass, the recording medium is transported in a transport amount corresponding to 33 raster units in the second transport direction 16. In other words, as for the transport of the recording medium shown in FIG. 10B, the transport corresponding to one raster unit to be performed three times and the transport corresponding to 33 raster units to be performed once are alternately repeated. In this way, the discharge of the ink droplets from the nozzles 301 and the transport of the recording medium in the second transport direction 16 by the driving roller 47 are alternately performed. Accordingly, the image is successively recorded on the recording medium from the forward end to the backward end thereof.

If the separation distance L3 between the downstream nozzle position P3 and the transport roller pair 54 is larger than the effective media length L1 of the media tray 71 (L3>L1), even when the image is recorded on the recording medium by means of arbitrary nozzles 301, then it is not feared that the media tray 71 may be brought in contact with the transport roller pair 54. On the contrary, if the effective media length L1 is larger than the total of the separation distance L3 and the nozzle length L2 (L1>L2+L3), even when the media tray 71 is transported in the first transport direction 15 until the media forward end position P1 of the media tray 71 abuts against the transport roller pair 54, then the printing backward end position P2 of the media tray 71 consequently protrudes in the second transport direction 16 from the upstream nozzle position P4. In order to record the image on the protruding portion, it is necessary that the media forward end position P2 of the media tray 71 should be moved in the first transport direction 15 beyond the nip point of the transport roller pair 54. Therefore, even when the image is recorded on the recording medium by means of any one of the nozzles 301, then the media tray 71 cannot be prevented from any contact with the transport roller pair 54. In the present teaching, the effective media length L1 is larger than the separation distance L3, and the effective media length L1 is smaller than the total of the nozzle length L2 and the separation distance L3 (L3<L1<L2+L3). Therefore, it is possible to avoid the contact between the media tray 71 and the transport roller pair 54 by recording the image on the recording medium by means of the specified nozzles 301.

In this procedure, if the vicinity of the backward end in the first transport direction 15 of the recording medium is subjected to the image recording with the nozzles 301 disposed in the vicinity of the most downstream side in the first transport direction 15, then the distance, which ranges from the downstream nozzle position P3 to the forward end in the first transport direction 15 of the media tray 71, is larger than the separation distance L3 which ranges from the downstream nozzle position P3 to the transport roller pair 54, and the media tray 71 consequently collides with the transport roller pair 54.

Figure 9:
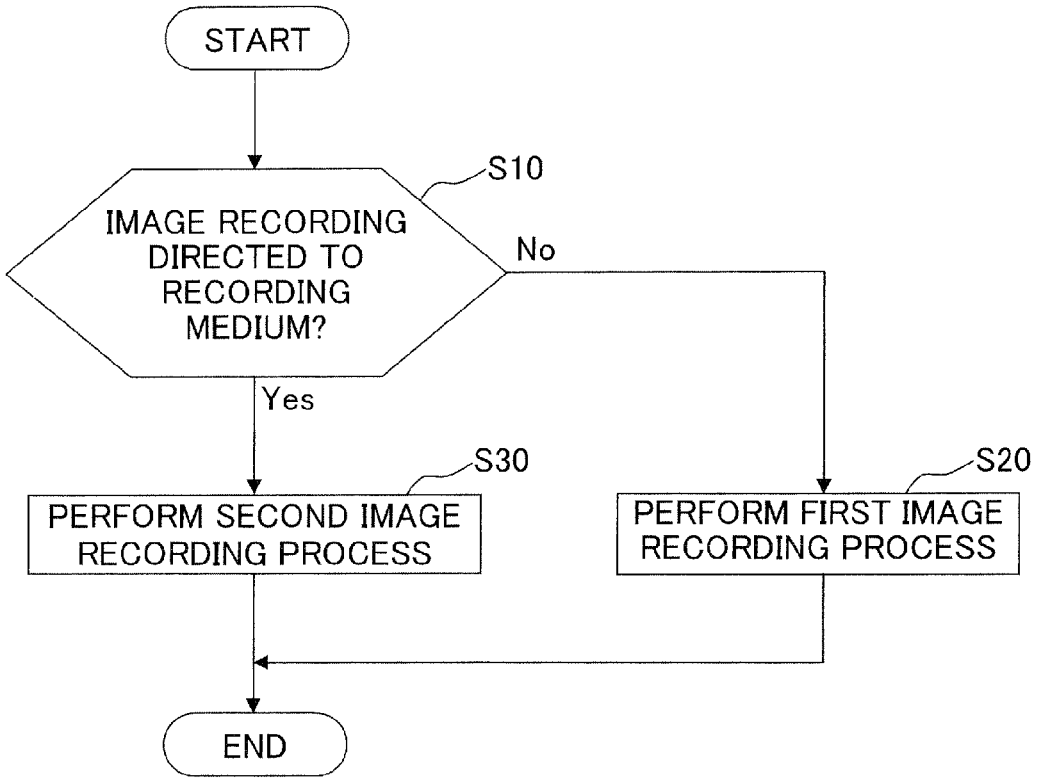
FIG. 9 shows a flow chart illustrating an exemplary procedure of the recording process performed by the control unit 130.

In the flow chart shown in FIG. 9 described above, for example, if the image recording is performed on the basis of FIG. 10A not on the basis of FIG. 10B, the media tray 71 consequently collides with the transport roller pair 54. This situation will be described in detail below. In FIG. 10A, in the first pass (1P), the distance between the printing backward end position P2 (position of the 1st raster) and the downstream nozzle position P3 (position of the nozzle N9) corresponds to 9 raster units. In this case, the effective media length of the media tray 71 is 85 raster units. Therefore, the length of protrusion of the media tray 71 from the downstream nozzle position P3 in the first transport direction 15 has the value obtained by subtracting the amount of 9 raster units described above from the effective media length (85 raster units), i.e., 76 raster units. In this case, the separation distance L3 is 55 raster units. The length (76 raster units) of protrusion of the media tray 71 from the downstream nozzle position P3 described above is larger than the separation distance L3 (55 raster units) from the downstream nozzle position P3 to the transport roller pair 54. Therefore, the media tray 71 consequently collides with the transport roller pair 54.

However, in this embodiment, the vicinity of the backward end in the first transport direction 15 of the recording medium (position within the fifth distance L5 in the first transport direction from the printing backward end position P2) is subjected to the printing with the nozzles 301 not disposed in the vicinity of the most downstream side in the first transport direction 15 (nozzles separated from the downstream nozzle position P3 in the second transport direction 16 by not less than the sixth distance L6). Therefore, the forward end in the first transport direction 15 of the media tray 71 is not separated toward the downstream side in the first transport direction 15 by not less than the separation distance L3 from the downstream nozzle position P3.

For example, when the image recording is performed on the basis of FIG. 10B as explained with reference to the flow chart shown in FIG. 9 described above, the media tray 71 does not collide with the transport roller pair 54. This feature will be described in detail below. In FIG. 10B, in the first pass (1P), the distance between the printing backward end position P2 (position of the 1st raster) and the downstream nozzle position P3 (position of the nozzle N9) is 33 raster units. In this case, the first distance is 85 raster units. Therefore, the length of protrusion of the media tray 71 from the downstream nozzle position in the first transport direction 15 has the value obtained by subtracting the amount of 33 raster units described above from the effective media length L1 of the media tray 71 (85 raster units), i.e., 52 raster units. In this case, the separation distance L3 from the downstream nozzle position P3 to the transport roller pair 54 is 55 raster units. The length (52 raster units) of protrusion of the media tray 71 from the downstream nozzle position P3 described above is smaller than the separation distance L3 (55 raster units) from the downstream nozzle position P3 to the transport roller pair 54. Therefore, the media tray 71 does not collide with the transport roller pair 54.

In this embodiment, the vicinity of the backward end in the first transport direction 15 of the recording medium is subjected to the image recording with the specified nozzles 301, and those other than the vicinity of the backward end are subjected to the image recording with arbitrary nozzles 301. Therefore, the image recording can be performed on all areas of the recording medium.

In this embodiment, the recording paper is interposed even when the recording paper is brought in contact with the transport roller pair 54 and the discharge roller pair 55, unlike the recording medium having a substantial thickness. Therefore, the recording paper is transported in the second transport direction 16 by means of the transport roller pair 54 and the discharge roller pair 55. Therefore, no problem arises even when arbitrary nozzles 301 are used in the image recording on the recording paper. The image recording can be performed to provide a high image quality by using arbitrary nozzles 301.

If the vicinity of the backward end in the first transport direction 15 of the recording medium is detected by the media sensor 110, it is feared that the media tray 71 may be already transported excessively in the first transport direction 15 at the point in time at which the vicinity of the backward end in the first transport direction 15 of the recording medium has been detected. In other words, it is feared that the distance from the downstream nozzle position P3 to the forward end in the first transport direction 15 of the media tray 71 may be excessively increased, and the media tray 71 may consequently collide with the transport roller pair 54. However, in this embodiment, the vicinity of the forward end in the first transport direction 15 of the recording medium (within the separation distance L3 in the second transport direction 16 from the media forward end position P1) is detected by the media sensor 110. Therefore, it is possible to avoid the collision between the media tray 71 and the transport roller pair 54 at the point in time at which the recording medium is detected by the media sensor 110.

First Modified Embodiment

Figure 12A:
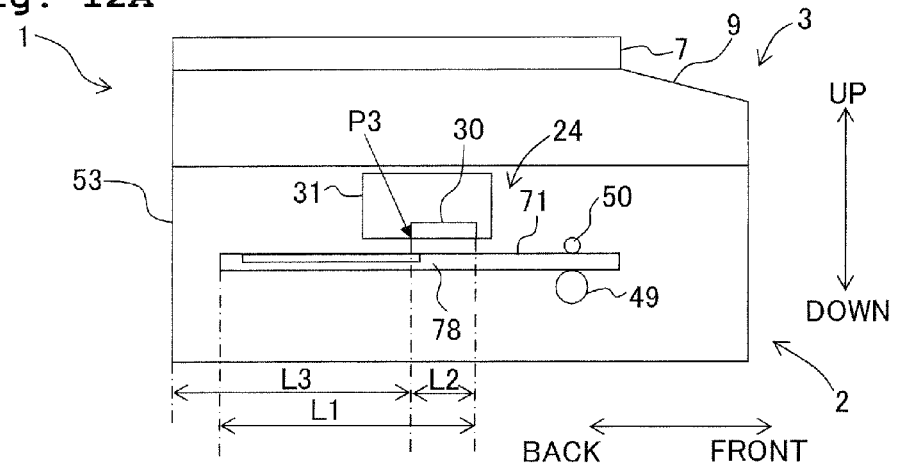

The foregoing embodiment has been explained for the case in which the interference member is the transport roller pair 54. However, the interference member may be the casing of the multifunction machine 1. As shown in FIG. 12A, for example, the interference member may be a portion of the casing 5 of the multifunction machine 1, wherein the portion intersects the area as provided by extending the recording medium or the media tray 71 in the first transport direction 15. For example, the concerning interference portion is a wall surface 53 for constructing the back surface of the multifunction machine 1. In this case, the separation distance L3 is the distance ranging from the downstream nozzle position P3 to the wall surface 53.

As described above, in the present teaching, the forward end of the media tray 71 in the first transport direction 15 is not separated toward the downstream side in the first transport direction 15 by not less than the separation distance L3 from the downstream nozzle position P3. Therefore, in the arrangement described above, as shown in FIG. 12A, it is possible to avoid the collision of the media tray 71 with the wall surface 53 of the multifunction machine 1. Further, it is possible to avoid the protrusion of the media tray 71 to the outside of the multifunction machine 1, which would be otherwise caused such that the media tray 71 protrudes toward the downstream side in the first transport direction 15 from the wall surface 53 of the multifunction machine 1.

Second Modified Embodiment

Figure 12B:
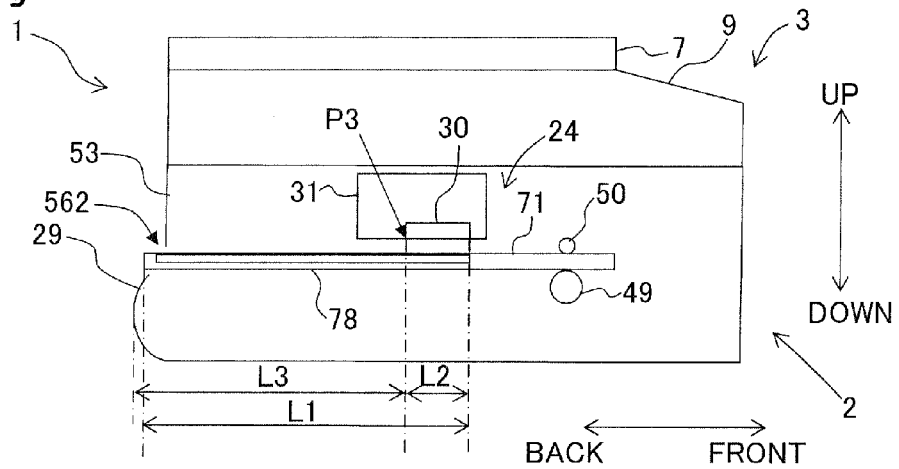

A protruding portion (corresponding to the protruding portion of the present teaching), which protrudes toward the downstream side in the first transport direction 15 from the back surface of the multifunction machine 1, may be provided for the multifunction machine 1. In this case, the separation distance L3 may be the distance ranging from the downstream nozzle position P3 to the forward end of the protruding portion allowed to most protrude toward the downstream side in the first transport direction 15 from the multifunction machine 1 in relation to the casing 5 of the multifunction machine 1. As shown in FIG. 12B, for example, when the outer guide surface 29 constitutes a part of the wall surface 53 of the back surface of the casing 5 of the multifunction machine 1, and the outer guide surface 29 is positioned backwardly as compared with the wall surface 53, then the outer guide surface 29 corresponds to the protruding portion. In this case, the interference member may be the outer guide surface 29. The separation distance L3 is the distance ranging from the downstream nozzle position P3 to the portion, of the outer guide surface 29, which is allowed to most protrude backwardly.

In FIG. 12B, the forward end of the media tray 71 in the first transport direction 15 can arrive at the vicinity of the portion, of the outer guide surface 29, which is allowed to most protrude backwardly. In this case, the portion of the media tray 71, which is disposed in the vicinity of the forward end in the first transport direction 15, consequently arrives at any backward position as compared with the wall surface 53 of the back surface of the multifunction machine 1. Therefore, in FIG. 12B, an opening 562 is bored in the wall surface 53 in order that the media tray 71 is allowed to penetrate therethrough.

Third Modified Embodiment

Figure 12C:
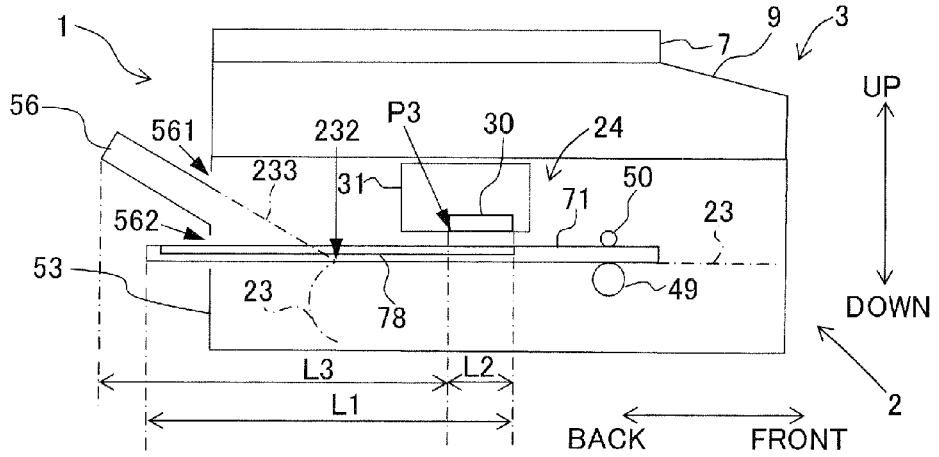

The protruding portion as explained in the second modified embodiment may be a manual feed tray 56 (an example of the second tray of the present teaching) which is configured to hold the recording paper sheets. As shown in FIG. 12C, for example, the manual feed tray 56 is inclined obliquely upwardly in the backward direction from the wall surface 53. A second transport passage 233 is formed to extend from the forward end (end portion on the front side) of the manual feed tray 56 to a merging point 232 at which the second transport passage 233 is merged with the transport passage 23 that is curved in order to make a U-turn of the recording paper. When a user of the multifunction machine 1 uses the manual feed tray 56, the recording paper is inserted toward the merging point 232 existing at the frontward position from an opening 561 bored through the wall surface 53 of the back surface of the multifunction machine 1 while being carried by the manual feed tray 56. The recording paper is transported to the position disposed under the recording section 24 by means of, for example, the transport roller pair 54 via the second transport passage 233. In the case of the arrangement as described above, the separation distance L3 is the distance ranging from the downstream nozzle position P3 to the portion, of the manual feed tray 56, which is allowed to most protrude backwardly.

In FIG. 12C, the forward end of the media tray 71 in the first transport direction 15 can arrive at the vicinity of the portion of the manual feed tray 56 which is allowed to most protrude backwardly. In this case, the portion of the media tray 71, which is disposed in the vicinity of the forward end in the first transport direction 15, consequently arrives at any backward position as compared with the wall surface 53 of the back surface of the multifunction machine 1. Therefore, in FIG. 12C, an opening 562, which is different from the opening 561 as described above, is bored through the wall surface 53 in order that the media tray 71 is allowed to penetrate therethrough.

The multifunction machine 1 is installed so that the portion, of the multifunction machine 1, which is allowed to most protrude on the back surface thereof, is not brought in contact with, for example, the wall of the room in which the multifunction machine 1 is installed. The most protruding portion of the multifunction machine 1 is, for example, the outer guide surface 29 described in the second modified embodiment or the manual feed tray 56 described in the third modified embodiment. When both of the outer guide surface 29 and the manual feed tray 56 are provided for the multifunction machine 1, the most protruding portion is the manual feed tray 56 in the case of FIGS. 12B and 12C. As described above, in the embodiment of the present teaching, the forward end in the first transport direction 15 of the media tray 71 is not separated toward the downstream side in the first transport direction 15 by not less than the separation distance L3 from the downstream nozzle position P3. Therefore, the media tray 71 does not further protrude from the portion of the multifunction machine 1 which is allowed to most protrude from the back surface thereof. Therefore, it is possible to avoid the collision of the media tray 71, for example, with the wall of the room in which the multifunction machine 1 is installed.

Fourth Modified Embodiment

The interference member may be a movable portion (corresponding to the movable portion of the present teaching) which is carried on the multifunction machine 1 and which is capable of performing the attitude change between the first attitude (corresponding to the first attitude of the present teaching) and the second attitude (corresponding to the second attitude of the present teaching). In the first attitude, there is a small protrusion toward the downstream side in the first transport direction 15 from the multifunction machine 1, i.e., toward the backward position, and in the second attitude, there is a large protrusion. When the second attitude is provided, the movable portion is allowed to most protrude toward the downstream side in the first transport direction 15 from the multifunction machine 1. In this case, the separation distance L3 is the distance ranging from the downstream nozzle position P3 to the portion of the movable portion which is allowed to most protrude toward the downstream side in the first transport direction 15 from the multifunction machine 1 when the second attitude is provided.

Figure 13A:
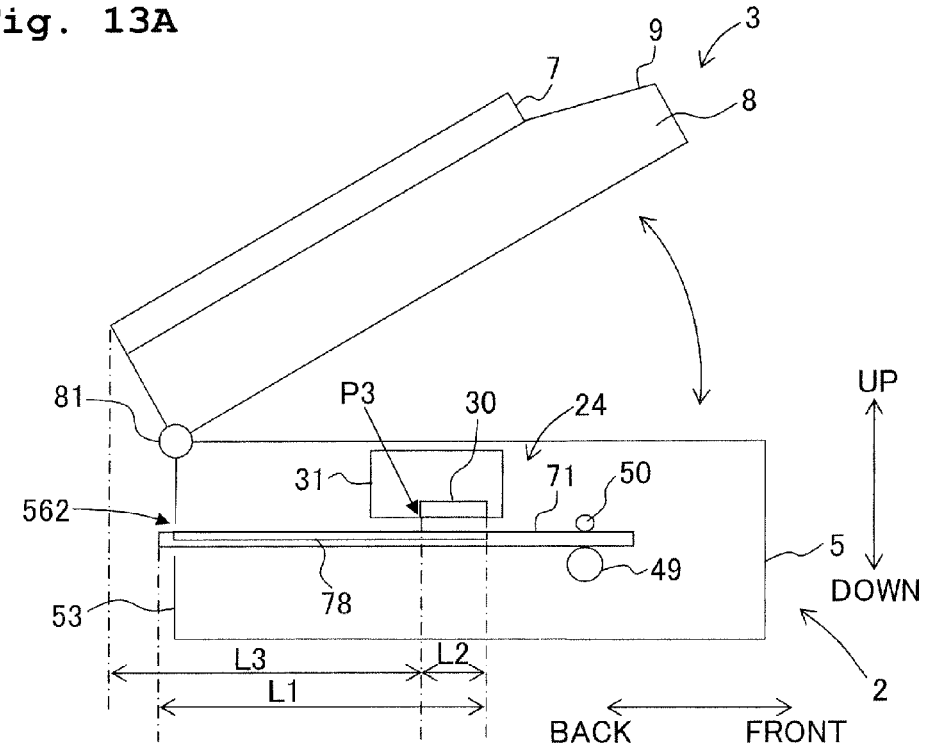

For example, the movable portion may be the scanner casing 8 of the scanner section 3 (example of the cover member of the present teaching). As shown in FIG. 13A, the scanner casing 8 is supported rotatably by a support mechanism such as a hinge 81 or the like on the backward side of the multifunction machine 1 so that the scanner casing 8 is openable/closable with respect to the upper surface of the casing 5. Accordingly, the scanner casing 8 is rotatable between the closed attitude (example of the first attitude of the present teaching, attitude as shown in FIG. 1) to cover the upper surface of the casing 5 and the open attitude (example of the second attitude of the present teaching, attitude as shown in FIG. 13A) to be open upwardly from the upper surface of the casing 5. In the fourth modified embodiment, the upper surface of the casing 5 is open. Therefore, when the scanner casing 8 is opened upwardly as shown in FIG. 13A, and the upper surface of the casing 5 is exposed, then the user can access the interior including, for example, the transport roller pair 54 from the upper surface of the casing 5. The user can perform, for example, the handing of jam and the maintenance for the constitutive components included in the printer section 2. Also in the fourth modified embodiment, an opening 562 is bored through the wall surface 53 so that the media tray 71 is allowed to penetrate therethrough in the same manner as in the third modified embodiment. In the case of the arrangement as described above, the separation distance L3 is the distance ranging from the downstream nozzle position P3 to the portion of the scanner casing 8 which is allowed to most protrude backwardly.

Fifth Modified Embodiment

Figure 13B:
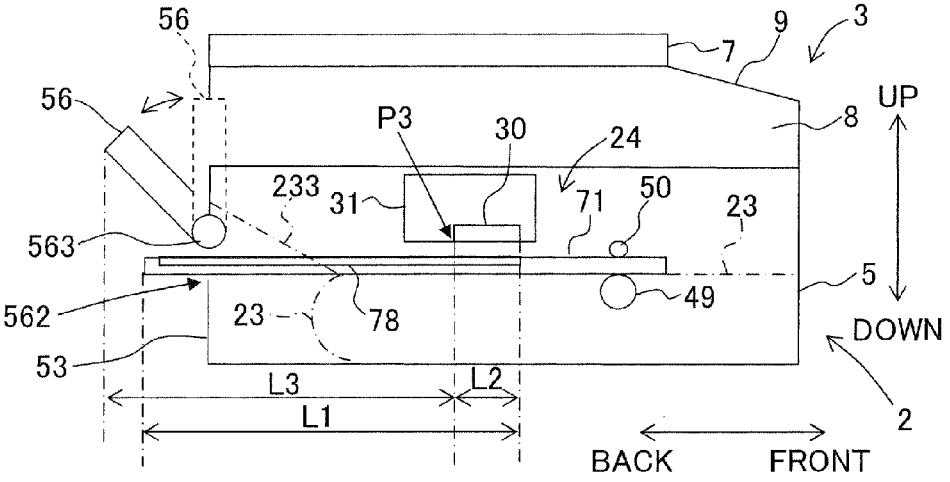

As another example of the movable portion explained in the fourth modified embodiment, the movable portion may be a manual feed tray 56 as described in the third modified embodiment, provided that the manual feed tray 56 is arranged rotatably (example of the third tray of the present teaching). As shown in FIG. 13B, for example, the manual feed tray 56 is supported rotatably by a support mechanism such as a hinge 563 or the like at the lower end portion of the manual feed tray 56 on the backward side of the multifunction machine 1 so that the manual feed tray 56 is openable/closable with respect to the wall surface 53 of the back surface of the multifunction machine 1. Accordingly, the manual feed tray 56 undergoes the attitude change between the second attitude indicated by solid lines (example of the second attitude of the present teaching) and the first attitude indicated by broken lines (example of the first attitude of the present teaching). When the manual feed tray 56 is in the first attitude, the manual feed tray 56 rises upstandingly along the wall surface 53. On the other hand, when the manual feed tray 56 is in the second attitude, the manual feed tray 56 is further inclined obliquely upwardly in the backward direction from the wall surface 53. The recording paper sheets of various sizes can be placed on the manual feed tray 56 in the second attitude. Also in the fifth modified embodiment, the second transport passage 233 and the opening 561 (not shown in FIG. 13B) are formed in the same manner as in the third modified embodiment. When the manual feed tray 56 is in the second attitude, the recording paper is inserted by the user of the multifunction machine 1. The opening 562, which is provided to allow the media tray 71 to penetrate therethrough, is bored in the same manner as in the third modified embodiment. In the case of the arrangement as described above, the separation distance L3 is the distance ranging from the downstream nozzle position P3 to the portion, of the manual feed tray 56, which is allowed to most protrude backwardly.

Sixth Modified Embodiment

Figure 14:
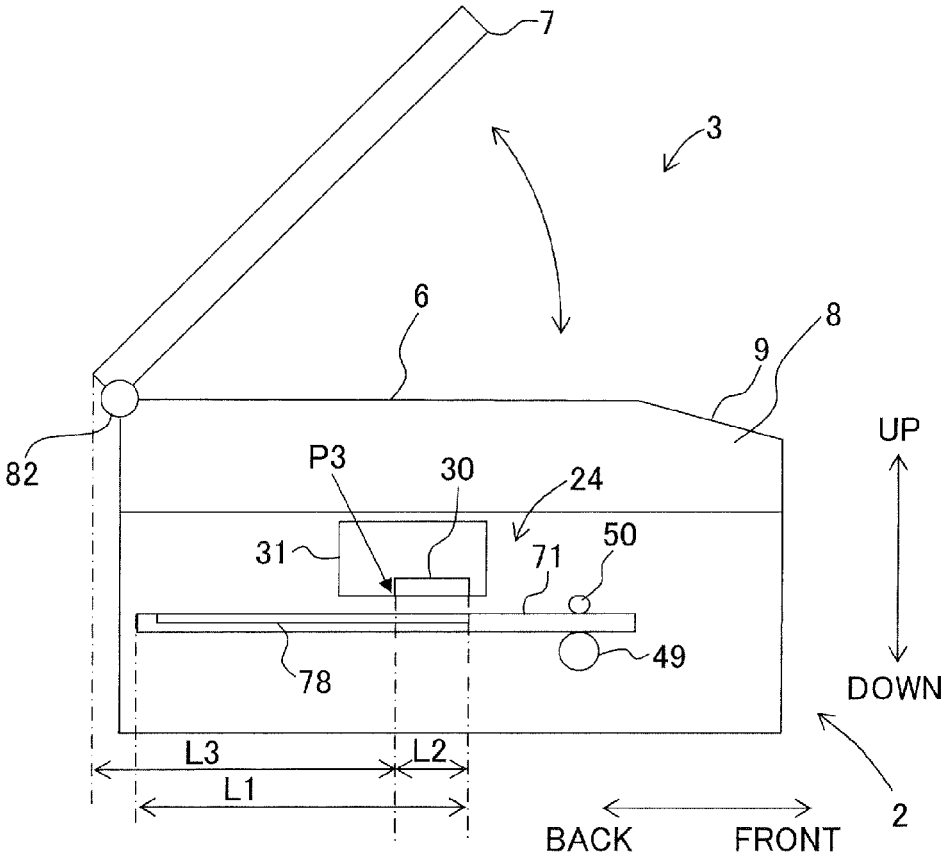
FIG. 14 shows a vertical sectional view of the multifunction machine 1 schematically illustrating the positional relationship among the image recording section 24, the media tray 71, and the interference member, in a case in which the interference member is a scanner section 3.

The movable portion may be the scanner section 3 as another example of the movable portion explained in the fourth modified embodiment. As shown in FIG. 14, the manuscript cover 7, of the scanner section 3, is supported rotatably by a support mechanism such as a hinge 82 or the like at the back portion of the multifunction machine 1 so that the manuscript cover 7 is openable/closable with respect to the platen glass 6 provided on the upper surface of the scanner casing 8. Accordingly, the manuscript cover 7 is capable of performing the attitude change between the closed attitude (example of the first attitude of the present teaching, attitude as shown in FIG. 1) to cover the platen glass 6 and the manuscript placed on the platen glass 6 and the open attitude (second attitude of the present teaching, attitude as shown in FIG. 14) to be open upwardly from the scanner casing 8. According to the above, the scanner section 3 is supported rotatably by the multifunction machine 1 to read the image recorded on the manuscript while covering the manuscript placed on the platen glass when the closed attitude is provided. Also in the sixth modified embodiment, the opening may be bored through the wall surface 53 in order that the media tray 71 is allowed to penetrate therethrough in the same manner as in the third modified embodiment. In the case of the arrangement as described above, the separation distance L3 is the distance ranging from the downstream nozzle position P3 to the portion of the scanner section 3 which is allowed to most protrude backwardly in the second attitude. The manuscript cover 7 may be integrated into one unit together with an ADF section (Automatic Document Feeder section) to continuously read a plurality of manuscripts.

The movable portion, which is capable of performing the attitude change, is carried on the multifunction machine 1 in some cases. Usually, in such a situation, the multifunction machine 1 is installed so that the multifunction machine 1 is not brought in contact with, for example, the wall of the room in which the multifunction machine 1 is installed, even when the movable portion has any attitude. The movable portion is, for example, the scanner casing 8 described in the fourth modified embodiment, the rotatable third tray 56 described in the fifth modified embodiment, and the scanner section 3 as described in the sixth modified embodiment. A plurality of movable portions as described above are sometimes carried on the multifunction machine 1. As described above, in the present teaching, the forward end of the media tray 71 in the first transport direction 15 is not separated toward the downstream side in the first transport direction 15 by not less than the separation distance L3 from the downstream nozzle position P3. Therefore, in the arrangements explained in the fourth to sixth modified embodiments, the media tray 71 does not further protrude from the forward end of the movable portion which is allowed to most protrude toward the downstream side in the first transport direction 15 from the back surface of the multifunction machine 1. Therefore, it is possible to avoid the collision of the media tray 71 with, for example, the wall of the room in which the multifunction machine 1 is installed.

Figure 15:
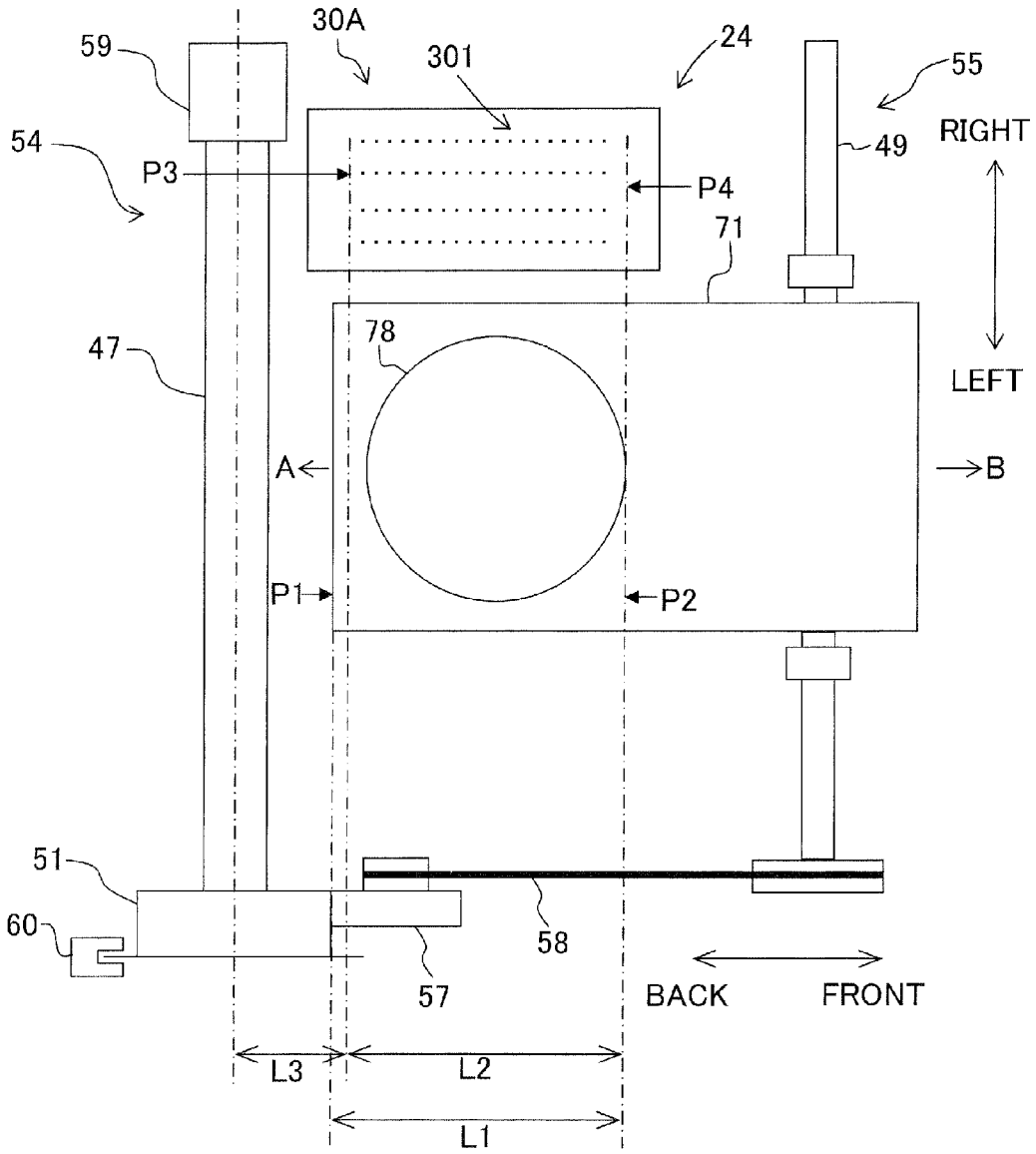
FIG. 15 shows an arrangement corresponding to FIG. 5, in which a lengthy recording head 30A is used.

In the embodiment and the modified embodiments thereof as described above, the relationship between the nozzle length L2 and the separation distance L3 resides in "separation distance L3>nozzle length L2". However, the present teaching is not limited thereto. The nozzle length L2 and the separation distance L3 may be arbitrary lengths provided that the relationship among the effective media length L1, the nozzle length L2, and the separation distance L3 resides in L3<L1<L2+L3 as described above. For example, as shown in FIG. 15, it is also possible to use a lengthy recording head 30A in which "nozzle length L2>separation distance L3" is provided.

What is claimed is:

1. An ink-jet recording apparatus comprising:

a first transport section configured to transport a first tray, on which a recording medium is placed, in a transport direction including a first transport direction and a second transport direction as a reverse direction of the first transport direction, the recording medium having an image formation area in which an image is to be formed;

a recording section that is provided on a downstream side in the first transport direction with respect to the first transport section, which includes a plurality of nozzles, arranged in the transport direction and including a first nozzle provided on a most downstream side in the first transport direction and a second nozzle provided on an upstream side in the first transport direction with respect to the first nozzle, and which is configured to record the image on the recording medium by discharging ink droplets from the nozzles;

a second transport section that is located on the downstream side, in the first transport direction, with respect to the recording section, the second transport section including:

a first roller that is rotatable by a driving force transmitted from a driving source; and a second roller that is arranged to be brought into contact with the first roller; and a control unit that is configured to control the first transport section and the recording section to:

perform a moving operation comprising:

stopping the first tray, inserted into the ink-jet recording apparatus from the upstream side in the first transport direction with respect to the first transport section, at a stop position at which the second nozzle faces a first recording area, included in the image formation area, and at which a most upstream portion in the first transport direction of the image formation area does not reach a facing position facing the first nozzle; and then moving the first tray in the second transport direction;

perform, during the moving operation of the first tray, image recording by discharging the ink droplets onto the recording medium placed on the first tray; and utilize, in a case of performing the image recording for the first recording area, the second nozzle and an upstream-side nozzle which is included in the plurality of nozzles and which is provided on the upstream side in the first transport direction with respect to the second nozzle;

wherein the second transport section is arranged to be separated and away from an end portion, in the first transport direction, of the recording medium or the first tray at a predetermined gap when the first tray is positioned at the stop position.

2. The ink-jet recording apparatus according to claim 1;

wherein the image formation area includes a second recording area located on the downstream side in the first transport direction with respect to the first nozzle when the first tray is positioned at the stop position; and wherein, in a case that the image recording is performed for the second recording area, the control unit controls the recording section to use an arbitrary nozzle included in the plurality of nozzles and different from the first and second nozzles.

3. The ink-jet recording apparatus according to claim 1;

wherein the control unit controls the recording section to use the arbitrary nozzle for a sheet-shaped recording medium, which is different from the recording medium and which is transported in the second transport direction by the second transport section.

4. The ink-jet recording apparatus according to claim 3, further comprising:

a fourth tray that is provided on the upstream side in the first transporting direction with respect to the recording section;

wherein the control unit controls the first transport section and the second transport section to transport a sheet-shaped recording medium, which is different from the recording medium, in the second transport direction such that the sheet-shaped recording medium is directed to the fourth tray from the second transport section via the first transport section.

5. The ink-jet recording apparatus according to claim 1, further comprising:

a detecting section that is configured to detect the recording medium and that is provided on the downstream side in the first transport direction with respect to a third position at which a nozzle of the most downstream side in the first transport direction is located.

6. An ink-jet recording apparatus comprising:

a first transport section configured to transport a first tray, on which a recording medium is placed, in a transport direction including a first transport direction and a second transport direction as a reverse direction of the first transport direction, the recording medium having an image formation area in which an image is to be formed;

a recording section that is provided on a downstream side in the first transport direction with respect to the first transport section, which includes a plurality of nozzles, arranged in the transport direction and including a first nozzle provided on a most downstream side in the first transport direction and a second nozzle provided on an upstream side in the first transport direction with respect to the first nozzle, and which is configured to record the image on the recording medium by discharging ink droplets from the nozzles;

a second transport section that is located on the downstream side, in the first transport direction, with respect to the recording section, the second transport section including:

a first roller that is rotatable by a driving force transmitted from a driving source; and a second roller that is arranged to be brought into contact with the first roller; and a control unit that is configured to control the first transport section and the recording section to:

perform a moving operation comprising:

stopping the first tray, inserted into the ink-jet recording apparatus from the upstream side in the first transport direction with respect to the first transport section, at a stop position at which the second nozzle faces a first recording area, included in the image formation area and located on a most upstream side in the first transport direction, and at which a most upstream portion in the first transport direction of the image formation area does not reach a facing position facing the first nozzle; and then moving the first tray in the second transport direction;

perform, during the moving operation of the first tray, image recording by discharging the ink droplets onto the recording medium placed on the first tray; and utilize, in a case of performing the image recording for the first recording area, the second nozzle and an upstream-side nozzle which is included in the plurality of nozzles and which is provided on the upstream side in the first transport direction with respect to the second nozzle; and wherein the second transport section is arranged to be separated and away from an end portion, in the first transport direction, of the recording medium or the first tray at a predetermined gap when the first tray is positioned at the stop position.

7. An ink-jet recording method applicable to an ink-jet recording apparatus;

the apparatus including:

a first transport section configured to transport a recording medium, or a first tray on which the recording medium is placed, in a transport direction including a first transport direction and a second transport direction as a reverse direction of the first transport direction, the recording medium having a forward end portion in the first transport direction and a backward end portion in the first transport direction in an image formation area in which an image is to be formed;

a recording section that is provided on a downstream side in the first transport direction with respect to the first transport section, which includes a plurality of nozzles, arranged in the transport direction and including a first nozzle provided on a most downstream side in the first transport direction and a second nozzle provided on an upstream side in the first transport direction with respect to the first nozzle, and which is configured to record the image on the recording medium by discharging ink droplets from the nozzles; and a second transport section that is located on the downstream side, in the first transport direction, with respect to the recording section the second transport section including:

a first roller that is rotatable by a driving force transmitted from a driving source; and a second roller that is arranged to be brought into contact with the first roller;

the ink-jet recording method comprising:

judging whether or not the recording medium is a sheet-shaped recording medium based on:

a detection result by a detection section that is configured to detect that the recording medium is inserted into the ink-jet recording apparatus from the upstream side, in the first transport direction, with respect to the first transport section, the first tray, or the recording medium placed on the first tray; or an instruction executed with respect to an operation section that is configured to instruct an operation of the ink-jet recording apparatus;

stopping the recording medium inserted into the ink-jet recording apparatus or the first tray at a stop position, at which:

the backward end portion does not reach a facing position facing the first nozzle; and the forward end portion is separated and away from the second transport section at the predetermined gap;

then moving the first tray or the recording medium in the second transport direction;

performing, while moving the first tray or the recording medium in the second transport direction, image recording on the recording medium inserted into the ink-jet recording apparatus or the recording medium placed on the first tray by discharging the ink droplets from the nozzles; and performing the image recording on the recording medium for a first recording area of the recording medium inserted into the ink-jet recording apparatus or of the recording medium placed on the first tray capable of facing the second nozzle when the recording medium or the first tray is positioned at the stop position, by using the second nozzle and an upstream-side nozzle that is included in the plurality of nozzles and that is provided on the upstream side in the first transport direction with respect to the second nozzle, under a condition that the recording medium is judged not to be the sheet-shaped recording medium when judging whether or not the recording medium is a sheet-shaped recording medium;

wherein the second transport section is arranged to be separated and away from an end portion, in the first transport direction, of the recording medium or the first tray at a predetermined gap when the first tray is positioned at the stop position.

* * * * *